US005738576A

United States Patent [19]

Ohno et al.

[11] Patent Number: 5,738,576

[45] Date of Patent: Apr. 14, 1998

[54] LAPPING TAPE WITH ABRASIVE LIQUID FOR FORMING A CONVEX TIP ON A WORKPIECE

[75] Inventors: Kenichi Ohno; Torahiko Kanda; Masashige Mitsuhashi, all of Tokyo, Japan

[73] Assignee: NEC Corporation, Tokyo, Japan

[21] Appl. No.: 789,136

[22] Filed: Jan. 28, 1997

Related U.S. Application Data

[62] Division of Ser. No. 684,615, Jul. 22, 1996.

[30] Foreign Application Priority Data

| | | | |
|---|---|---|---|
| Jul. 21, 1995 | [JP] | Japan | 7-207646 |
| Mar. 29, 1996 | [JP] | Japan | 8-075779 |
| Apr. 10, 1996 | [JP] | Japan | 8-088026 |

[51] Int. Cl.[6] ..... B24D 11/00

[52] U.S. Cl. ..... 451/539; 451/533; 451/535

[58] Field of Search ..... 451/533–539; 51/295, 297, 298

[56] References Cited

U.S. PATENT DOCUMENTS

| | | | |
|---|---|---|---|
| 3,787,273 | 1/1974 | Okrepkie et al. | 451/539 |
| 3,971,163 | 7/1976 | Trombley et al. | 451/163 |
| 4,606,154 | 8/1986 | Herrmann et al. | 51/297 |
| 4,928,435 | 5/1990 | Masaki et al. | 451/42 |
| 5,048,238 | 9/1991 | Ikeda | 451/60 |
| 5,136,820 | 8/1992 | Luther | 451/59 |
| 5,216,846 | 6/1993 | Takahashi | 451/57 |
| 5,341,609 | 8/1994 | Gorsuch et al. | 451/533 |
| 5,349,784 | 9/1994 | Grois et al. | 451/59 |
| 5,387,457 | 2/1995 | Sato | 451/533 |
| 5,447,464 | 9/1995 | Franklin et al. | 451/57 |
| 5,464,361 | 11/1995 | Suzuki et al. | 451/42 |
| 5,547,418 | 8/1996 | Takahashi | 451/41 |
| 5,549,719 | 8/1996 | Lee et al. | 51/298 |
| 5,611,836 | 3/1997 | Ryoke et al. | 451/539 |

FOREIGN PATENT DOCUMENTS

| | | | |
|---|---|---|---|
| 59-192448 | 10/1984 | Japan . | |
| 102862 | of 1988 | Japan . | |
| 4-2388 | 1/1992 | Japan . | |
| 406182670 | 7/1994 | Japan | 451/534 |

*Primary Examiner*—Robert A. Rose
*Assistant Examiner*—George Nguyen
*Attorney, Agent, or Firm*—Sughrue, Mion, Zinn, Macpeak & Seas, PLLC

[57] ABSTRACT

A method and an apparatus for providing an optical fiber connector or similar workpiece formed of, e.g., glass, ceramic or plastic with a mirror-finished convex tip efficiently is disclosed. While a film-like abrasive tool is conveyed in contact with the wall of a groove formed in a stage, the workpiece is caused to rotate about its axis (and to move in a reciprocating motion). By the resulting grinding operation, the sectional shape (arcuate) of the abrasive tool contacting the wall of the groove is transferred to the end of the workpiece. As a result, the end of the workpiece is provided with a convex tip. The abrasive tool is replaced with an abrasive tool for finishing, as needed.

5 Claims, 18 Drawing Sheets

LAPPING TAPE WITH ABRASIVE LIQUID FOR FORMING A CONVEX TIP ON A WORKPIECE

This is a divisional of application Ser. No. 08/684,615 filed Jul. 22, 1996.

BACKGROUND OF THE INVENTION

The present invention relates to a method and an apparatus for forming a convex tip on the end of a rod- or block-like workpiece formed of glass, ceramic, plastic or similar material. More particularly, the present invention relates to a method and an apparatus for providing an optical fiber connector with a mirror-finished convex tip.

A optical fiber communication system extensively used today uses optical fibers capable of transmitting a considerable amount of data stably. When optical fibers are connected to each other for the propagation of optical signals, optical losses ascribable to the gap between the ends of the fibers must be reduced as far as possible. A predominant implementation for the low loss connection of optical fibers is a PC (Physical Contact) optical connector. The PC optical connector has a ferrule at its end. The end of the ferrule is mirror-finished in a convex tip configuration. This allows the end of an optical fiber received in the ferrule to closely contact the end of another optical fiber. To produce the PC optical connector, a fiber is inserted into and affixed to the ferrule. As a result, an excess part of the fiber as well as an excess part of adhesive is left protruding from the end of the ferrule. It has been customary to remove the excess fiber and excess adhesive by rough grinding in the event of mirror-finishing the end of the ferrule in a convex configuration.

Japanese Patent Laid-Open Publication No. 63-102863 (corresponding to Japanese Patent Publication No. 4-2388), for example, teaches a method consisting of the following steps. First, the end of the ferrule is ground by a rotary grindstone or lapped by an liquid containing abrasive grain in a conical configuration. A rotary stage has an elastic sheet set thereon. Abrasive grain is deposited on the sheet by spraying. The ferrule having the conical end is rotated about its axis with the end pressed against the sheet. As a result, the end of the ferrule is provided with a smooth convex configuration due to the local deformation of the sheet and the finishing function of the abrasive grain.

However, the above procedure cannot provide the ferrule with a smooth convex tip unless the finishing ability available with the elastic sheet and abrasive grain is maintained adequate at all times. Further, because the formation of the convex tip relies on the local deformation of the elastic sheet, the sheet is apt to deteriorate. Therefore, with the conventional method, it is difficult to work a number of workpieces continuously and efficiently. To provide a number of workpieces with stable convex tips, the sheet and abrasive grain must be frequently replaced, resulting in low productivity.

Moreover, the use of the abrasive liquid containing the abrasive grain must results in the need for a liquid supply apparatus and a liquid tank which obstruct the miniaturization of the entire apparatus. In addition, the apparatus cannot be easily transported because the liquid drops when the apparatus is tilted. During the course of working, the apparatus must be held in a horizontal position.

SUMMARY OF THE INVENTION

It is therefore an object of the present invention to provide a method and an apparatus for providing a workpiece with a mirror-finished convex tip and capable of reducing the working time and promoting efficient work while preserving accuracy.

It is another object of the present invention to provide a lapping tape preserving a stable working ability even when the work is interrupted or when the tape is stored over a long period of time.

In accordance with the present invention, a method of forming a convex tip on the end of a workpiece by using a film-like abrasive tool has the steps of positioning the abrasive tool on a stage, causing the end of the workpiece to contact one of opposite major surfaces of the abrasive tool, and causing the workpiece to rotate about an axis thereof, while moving the abrasive tool.

Also, in accordance with the present invention, an apparatus for forming a convex tip on the end of a workpiece has a stage, a film-like abrasive tool set on the stage and for grinding the end of the workpiece, a moving mechanism for causing the abrasive tool to move, a rotating mechanism for causing the abrasive tool to rotate about an axis thereof, and a contacting mechanism for causing the end of the workpiece to contact the stage.

Further, in accordance with the present invention, an apparatus for forming a convex tip on the end of a workpiece has a stage formed with a plurality of concentric annular grooves each having a generally arcuate section, a film-like abrasive tool positioned on the walls of the plurality of concentric grooves, a mechanism for causing the workpiece to rotate about an axis thereof, a mechanism for causing the workpiece to move along any one of the plurality of concentric grooves, a mechanism for causing the workpiece to move across the plurality of concentric grooves, and a mechanism for causing the end of the workpiece to contact the abrasive tool contacting the walls of the plurality of concentric grooves.

Moreover, in accordance with the present invention, a lapping tape for forming a convex tip on the end of a workpiece has a thin base in the form of a webbing, abrasive grain affixed to the front of the base by a binder, and an abrasive liquid deposited in a layer on the front of the base to which the abrasive grain is affixed.

BRIEF DESCRIPTION OF THE DRAWINGS

The above and other objects, features and advantages of the present invention will become apparent from the following detailed description taken with the accompanying drawings in which.

In the figures, like reference numerals designate like structural parts.

DESCRIPTION OF THE PREFERRED EMBODIMENTS

Figure 1:
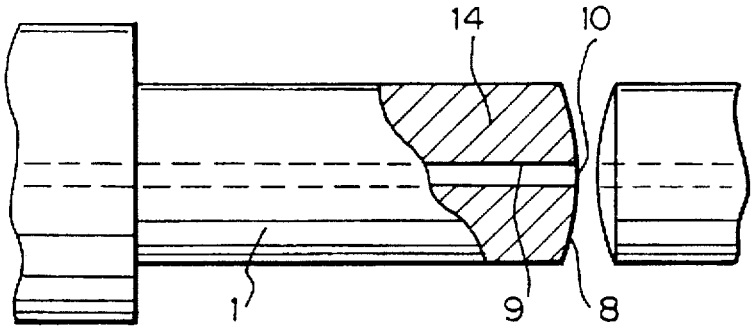
Fig. 1 PRIOR ART
FIG. 1 shows how an optical fiber connector has its convex tip connected to the end of an optical fiber also provided with a convex configuration.

To better understand the present invention, a brief reference will be made to a conventional method and apparatus for providing a workpiece, particularly an optical fiber connector, with a convex tip. FIG. 1 shows the connecting portion of a PC optical fiber connector 1 mirror-finished to have a convex or tip. As shown, the connector 1 has a ferrule 14 at the end of an optical fiber 9. The ferrule 14 has its end face 8 mirror-finished to have a convex tip. In this connection, the end 10 of the fiber 9 surrounded by the ferrule 14 is held in close contact with the end of another optical fiber.

Figure 2A:
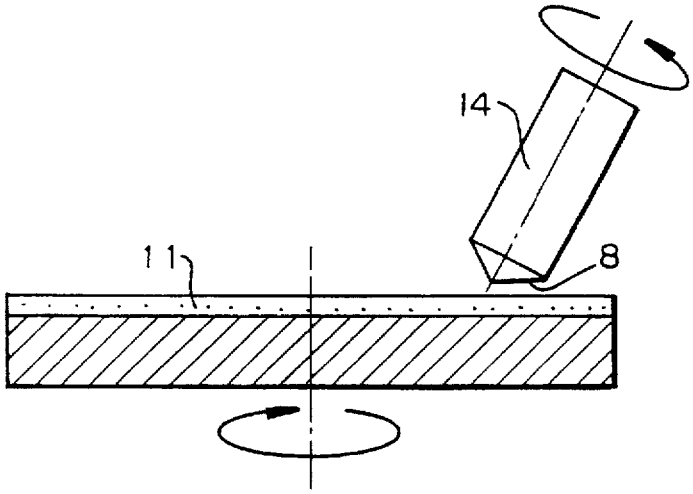
Fig. 2A PRIOR ART
FIGS. 2A and 2B demonstrate a conventional method of providing the end of a ferrule included in the connector of FIG. 1 with the convex tip.
Figure 2B:
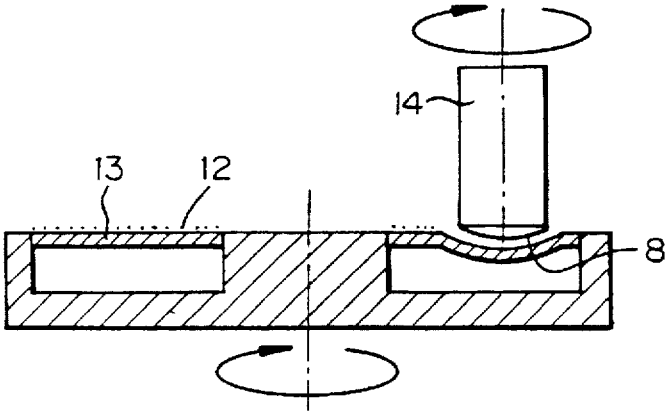
Fig. 2B PRIOR ART

A reference will also be made to FIGS. 2A and 2B for describing a conventional method of providing the end 8 of the ferrule 14 with a convex tip and taught in, e.g., previously mentioned Laid-Open Publication No. 63-102863. To produce the PC optical connector, the fiber 9 is inserted into and affixed to the ferrule 14. As a result, an excess part of the fiber 9 as well as an excess part of adhesive is left protruding from the end of the ferrule 14. The method begins with a step of roughly grinding the excess fiber 9 and excess adhesive. Then, as shown in FIG. 2A, the end 8 of the ferrule 14 is ground by a grindstone 11 or lapped by a grinding liquid containing abrasive grain a conical configuration. FIG. 2B shows a rotary stage and an elastic sheet 13 set on the stage. Abrasive grain 12 is deposited on the sheet 13 by spraying. The ferrule 14 ground in the step of FIG. 2A is rotated about its axis with the end 8 pressed against the sheet 13. As a result, the end 8 is mirror-finished to have a smooth convex tip due to the local deformation of the sheet 13 and the finishing function of the abrasive grain 12.

The above conventional method, however, has some problems yet to be solved, as discussed earlier. Preferred embodiments of the present invention free from such problems will be described hereinafter.

1st EMBODIMENT

Figure 3:
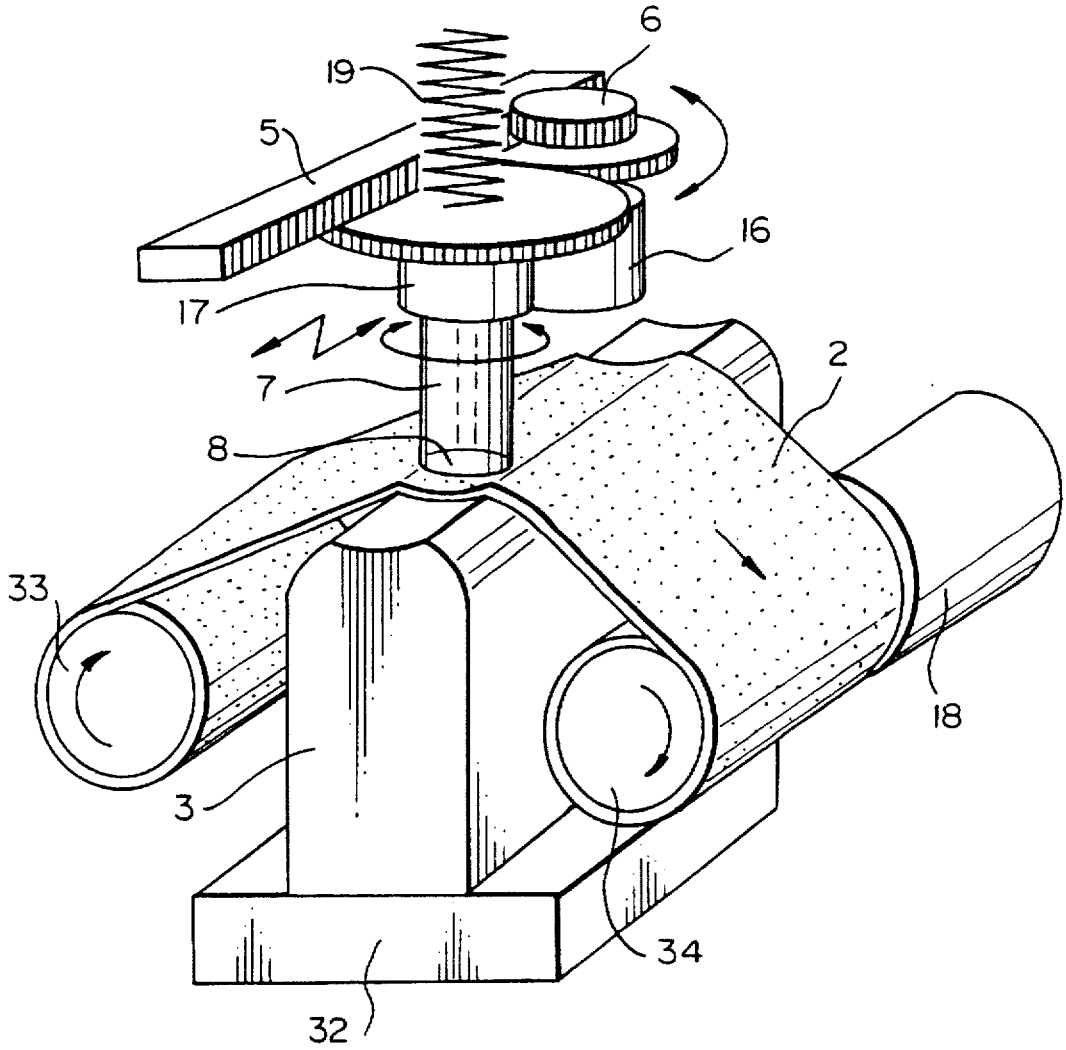
FIG. 3 is a perspective view showing the first embodiment of the convex tip forming apparatus in accordance with the present invention.
Figure 4:
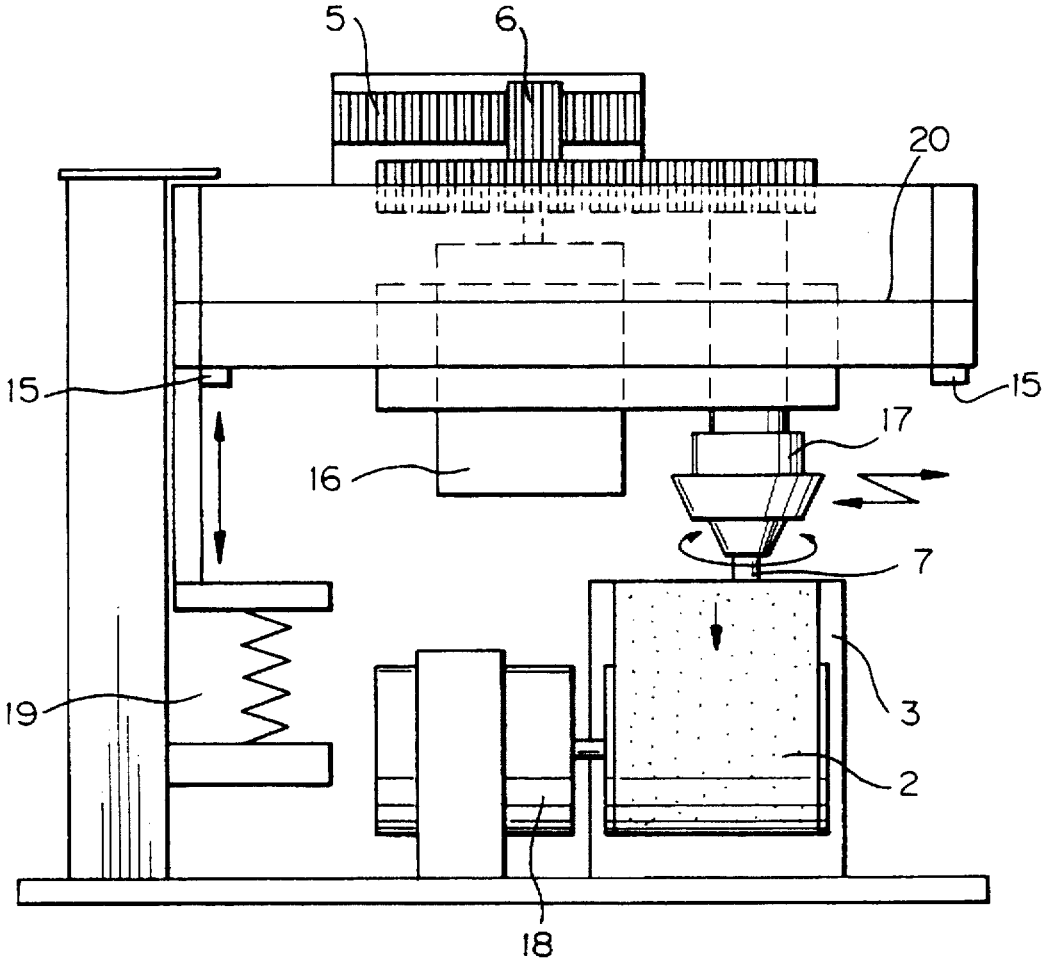
FIG. 4 is a front view of the apparatus shown in FIG. 3.

Referring to FIGS. 3 and 4, a convex tip forming apparatus embodying the present invention is shown. As shown, the apparatus has a stage 3 formed with a groove having an arcuate section in its top over a preselected length. A positioning mechanism 32 adjusts the position of the stage 3. A film-like abrasive tool, or abrasive film as referred to hereinafter, 2 extends from a feed roller 33 to a take-up roller 34 by way of the top of the stage 3, as illustrated. A roller motor 18 drives the roller 34 in order to take up the abrasive film 3. A chuck 17 chucks a workpiece 7 and is reversibly rotated about its axis by a chuck motor 16. A rack 5 and a pinion 6 cause the chuck 17 to move along the groove of the stage 3. A constant load mechanism 19 exerts a preselected load on the workpiece 7. A rail 20 guides and holds the workpiece 7.

To provide the end 8 of a workpiece 7 with a convex tip, the abrasive film 2 having a preselected length and a relatively large grain size has its opposite ends wrapped around the feed roller 33 and take-up roller 34, respectively. Then, the workpiece 7 and the arcuate or concave surface of the film 2 are brought into contact with the axis of the former and the center of curvature of the latter aligning with each other. Subsequently, the roller motor 18 is energized to convey the film 2 at a low speed while the chuck motor 16 is energized to rotate the workpiece 7 held by the chuck 17.

The pinion 6 and rack 5 are driven in interlocked relation to the rotation of the chuck motor 16. As a result, the chuck 17 moves along the groove of the stage 3 in parallel to the rack 5 while rotating about its axis. When the end 8 of the workpiece 7 arrives at one end of the stage 3, a switch 15 located at the end of the stage 3 is operated to reverse the rotation of the chuck motor 16. This reverses the rotation of the pinion 6 and the movement of the rack 5. Consequently, the chuck 17 is moved in the reverse direction toward the other end of the stage 3. Another switch 15 is provided at the other end of the stage 3, so that the end 8 of the workpiece 7 is movable back and forth within the range of the width of the film 2.

The apparatus repeats the above grinding or primary working with a plurality of consecutive workpieces 7. When the film 2 is fully taken up by the take-up roller 34, it is replaced with another abrasive film 2 having a smaller grain size. Then, the apparatus with the new abrasive film 2 finishes the ground workpieces 7 in the same manner as during grinding (secondary working). The film 2 sequentially finishes the end 8 of each workpiece to form a smooth convex tip. The secondary working ends when convex tip is formed up to a preselected portion of the workpiece 7.

The concave or arcuate surface of the stage 3 is free from deformation and allows the the end 8 of the workpiece 7 to be stably finished in a convex configuration without fail. The finished convex tip 8 has a radius equal to the radius of curvature of the groove of the stage 3. Further, because the end 8 of the workpiece 7 always contacts a fresh part of the abrasive film 2, it is free from scratches and other defects ascribable to the stop-up of the abrasive film 2. In addition, only if the abrasive film 2 has a sufficient length, the frequent replacement of the abrasive grain 12 and sheet 13 particular to the conventional method is not necessary. This enhances the efficient operation of the apparatus.

Example 1 to which the first embodiment is actually applied will be described.

Example 1

The stage 3 was formed of Teflon and formed with an arcuate groove having a radius of curvature of 20 mm. The abrasive film 2 consisted of a 150 m long, 25 mm wide and 25 μm thick base, and $A1_2O_3$ abrasive grain with a gain size of 8 μm. The workpiece 7 was implemented as an optical fiber connector having a glass ferrule having a diameter of 2.5 mm and in which an optical fiber having a diameter of 125 μm was inserted. The ratio of the outside diameter of a gear mounted on the chuck motor 16 to that of a gear mounted on the chuck 17 was selected to be 2:1, so that the workpiece 7 was rotated twice for one rotation of the motor 16.

The constant load mechanism 19 exerted a load of 150 g f on the workpiece 7 in the vertical direction. In this condition, the chuck motor 16 was rotated at a speed of 200 rpm for 3 minutes for the primary working. After 500 workpieces 7 had been consecutively worked, the abrasive film 2 was replaced with a new abrasive film having a smaller grain size. Then, while the constant load mechanism 19 exerted a load of 150 gf on the ground workpiece 7 in the vertical direction, the chuck motor 16 was rotated at a speed of 200 rpm for 2 minutes for the secondary working or finishing. The abrasive film 2 used for finishing consisted of a 100 m long, 25 mm wide and 25 μm thick base, and diamond abrasive grain deposited on the base and having a grain size of 1.5 μm.

Example 1 was capable of grinding and finishing 500 consecutive workpieces continuously and reduced the frequency of replacement of the abrasive tool to one-tenth of the frequency particular to the conventional method. The working time for a single workpiece was only 7 minutes, including the time for the replacement of the workpiece and abrasive tool or film 2. The mirror-finished convex tip formed on the end of each workpiece 7 had a radius of curvature of 20±1 mm and a surface roughness of less than 0.03 μm Rmax inclusive. The resulting optical fiber connector was found to have a connection loss smaller than of 0.2 dB inclusive and a reflection attenuation of greater than 45 dB inclusive.

Figure 5A:
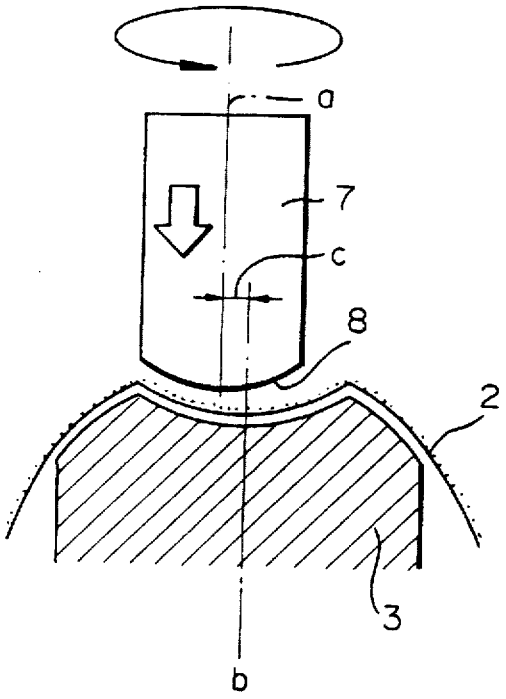
FIGS. 5A and 5B show a modified operation available with the apparatus shown in FIGS. 3 and 4.
Figure 5B:
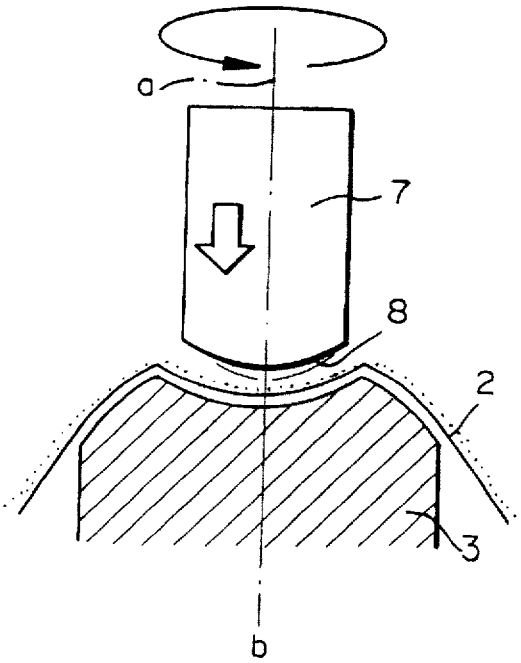

With Example 1, it is also possible to work the end 8 of the workpiece 7 by a different procedure. FIGS. 5A and 5B show a modified operation of the first embodiment. First, as shown in FIG. 5A, the positioning mechanism 32 is operated to shift the center, as viewed in a section, of the groove of the stage 3 from the axis of rotation a of the workpiece 7 by a preselected distance c. Then, the workpiece 7 and stage 3 are brought into contact in order to grind the end 8 of the workpiece 7 in a conical configuration. Subsequently, as shown in FIG. 5, the center of the groove of the stage 3 is aligned with the axis of rotation a of the workpiece 7. After the workpiece 7 and stage 3 have been caused to contact each other, the end 8 of the workpiece 7 is finished to form a smooth convex tip. Again, the finishing work ends when the convex tip is formed up to a preselected portion of the end 8. In this manner, the modified operation provides the end 8 of the workpiece 7 with a conical shape beforehand. This successfully reduces the cost and labor necessary for finishing as well as the finishing time.

Example 2 relating to the above modification is as follows.

Example 2

As shown in FIG. 5A, the center b of the groove of the stage 3 was shifted from the axis of rotation a of the workpiece 7 by a distance c of 500 μm by the positioning mechanism 32. Then, the workpiece 7 held by the chuck 17 and the abrasive film 2 was brought into contact with each other. The film 2 consisted of a 105 m long, 25 mm wide and 25 μm thick base, and $A1_2O_3$ abrasive grain deposited on the base and having a grain size of 8 μm. The workpiece 7 was subjected to primary working using the abrasive film 2 for 3 minutes under the same conditions as in Example 1. Then, as shown in FIG. 5B, the center b of the groove of the stage 3 was brought into alignment with the axis of rotation a of the workpiece 7 by the positioning mechanism 32. After the workpiece 7 and stage 3 had been caused to contact each other, the workpiece 7 was finished by a new abrasive film 2 for 1 minute under the same conditions as in Example 1. The new abrasive film consisted of a 50 m long, 25 mm wide and 25 μm thick base, and diamond abrasive grain deposited on the film and having a grain size of 1.5 μm.

Example 2 could also grind and finish 500 consecutive workpieces continuously and reduced the frequency of replacement of the abrasive tool to one-tenth of the frequency particular to the conventional method. The working time for a single workpiece was only 6 minutes, including the time for the replacement of the workpiece and abrasive toot or film 2. The convex tip formed on the end of each workpiece had a radius of curvature of 20±1 mm and a surface roughness of less than 0.03 μm Rmax inclusive. The resulting optical fiber connector was found to have a connection loss of smaller than 0.2 dB inclusive and a reflection attenuation of greater than 45 dB inclusive.

2nd Embodiment

Figure 6:
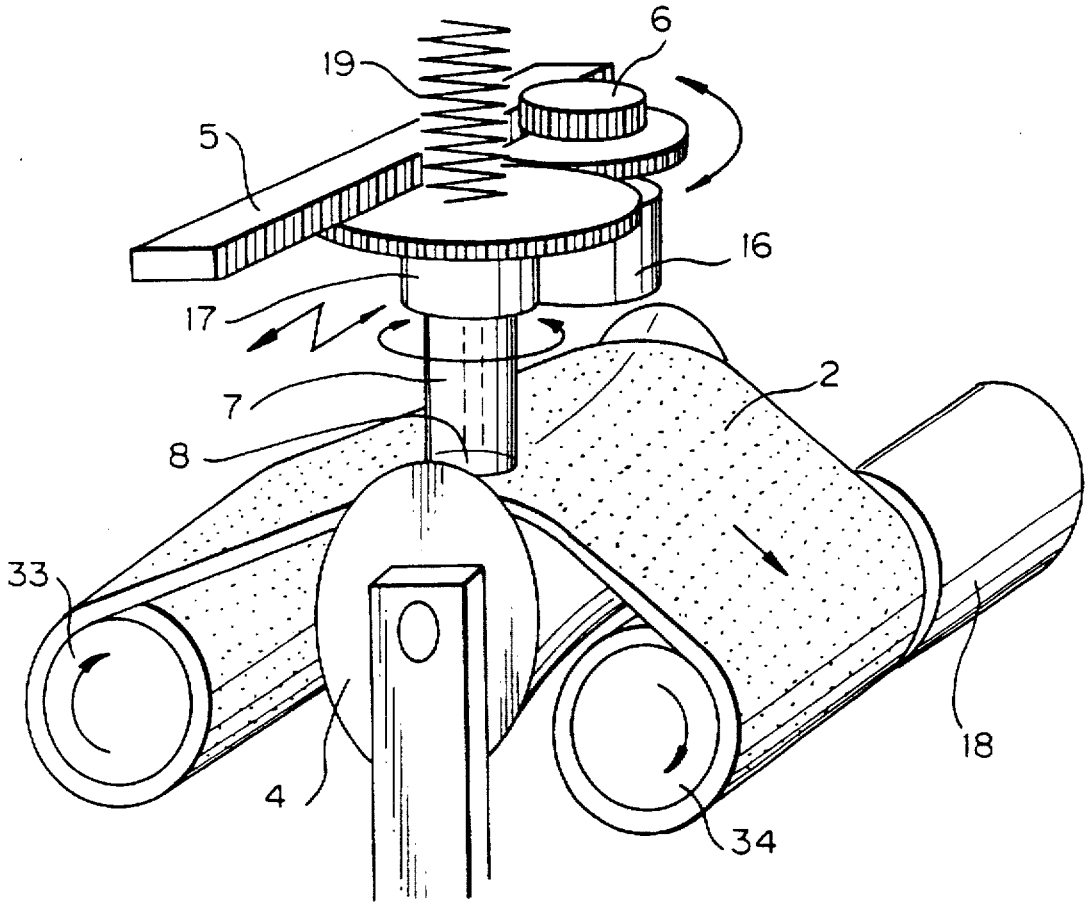
FIG. 6 is a perspective view showing a second embodiment of the present invention.
Figure 7:
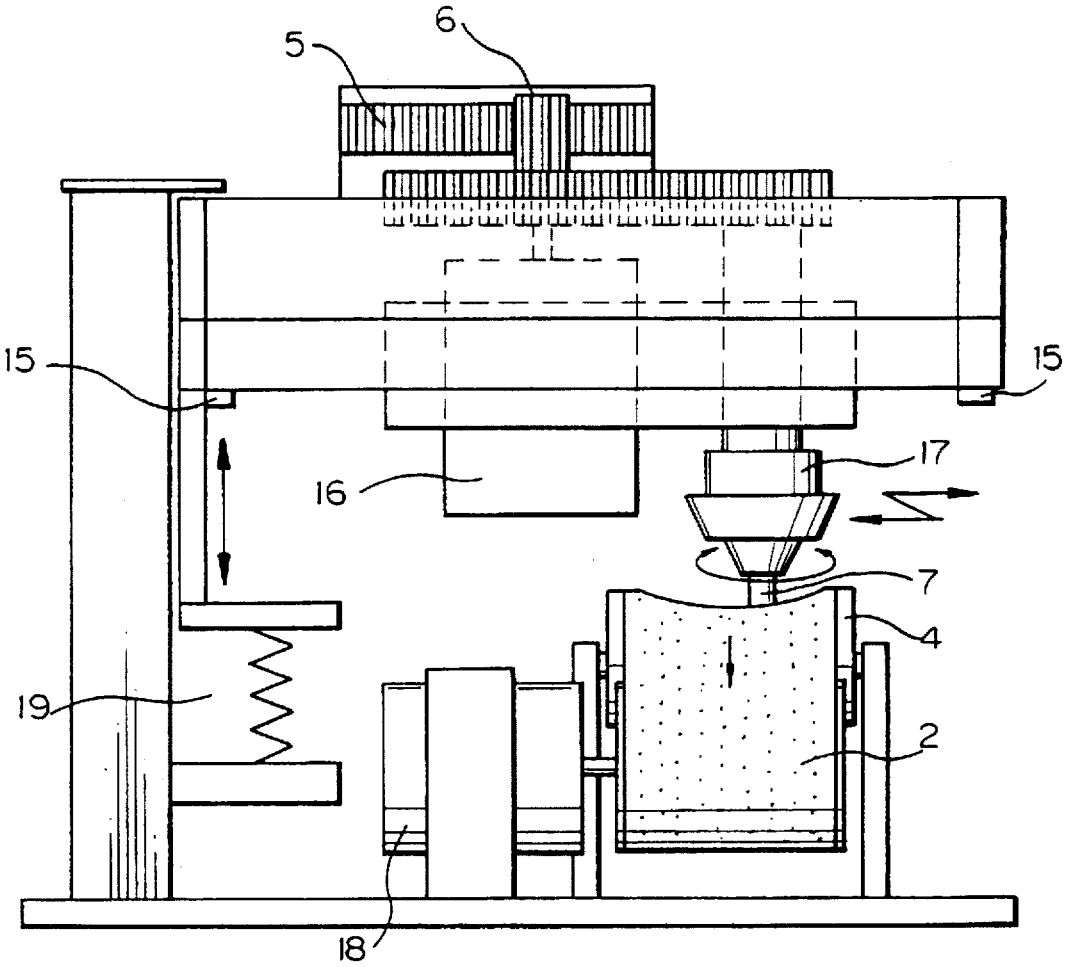
FIG. 7 is a front view of the apparatus shown in FIG. 6.

A reference will be made to FIGS. 6 and 7 for describing a second embodiment of the present invention. As shown, a roller 4 serves as a stage and has a hand-drum-like configuration, i.e., a concave top and a concave bottom as seen in a section. An abrasive film 2 is wrapped around the feed roller 33 at one end and around the take-up roller 34 at the other end and passed over the top of the roller 4, as illustrated. The roller motor 18 drives the roller 34 in order to take up the abrasive film 2. The chuck 17 chucks the workpiece 7 and is reversibly rotated about its axis by the chuck motor 16. The rack 5 and pinion 6 cause the chuck 17 to move in the lengthwise direction of the roller 4. The constant load mechanism 19 exerts a preselected constant load on the workpiece 7.

To provide the end 8 of the workpiece 7 with a convex tip, the abrasive film 2 having a preselected length and a relatively large grain size has its opposite ends wrapped around the feed roller 33 and take-up roller 34, respectively.

Then, the workpiece 7 and the arcuate or concave surface of the abrasive film 2 are brought into contact with the axis of the former and the center of curvature of the latter aligning with each other. Subsequently, the roller motor 18 is energized to convey the abrasive film 2 at a low speed while the chuck motor 16 is energized to rotate the workpiece 7 held by the chuck 17. The pinion 6 and rack 5 are driven interlocked relation to the rotation of the chuck motor 16. As a result, the chuck 17 moves in the lengthwise direction of the rack 5 while rotating about its axis. When the end 8 of the workpiece 7 arrives at one end of the roller 4, the switch 15 located at the end of the roller 4 is operated to reverse the rotation of the chuck motor 16. In this manner, the workpiece 7 is moved back and forth while rotating about its axis, and ground in a convex configuration thereby (primary working).

The apparatus repeats the primary working with a plurality of consecutive workpieces 7. When the film 2 is fully taken up by the take-up roller 34, it is replaced with another abrasive film 2 having a smaller grain size. Then, the apparatus with the new abrasive film 2 finishes the workpieces 7 in the same manner as during the primary working (secondary working). The film 2 sequentially finishes the end 8 of each workpiece to form a smooth convex tip. The secondary working ends when a convex tip is formed up to a preselected portion of the workpiece 7.

The concave surface of the roller 4, as seen in a section, is free from deformation ascribable to grinding and finishing and allows the end 8 of the workpiece 7 to be stably finished in a convex configuration without fail. The finished convex tip 8 has a radius equal to the radius of curvature of the roller 4 as seen in a sectional front view.

Further, because the end 8 of the workpiece 7 always contacts a fresh part of the abrasive film 2, it is free from scratches and other defects ascribable to the stop-up of the abrasive film 2. In addition, only if the abrasive film 2 has a sufficient length, the frequent replacement of the abrasive grain 12 and sheet 13 particular to the conventional method is not necessary. This enhances the efficient operation of the apparatus.

Example 3 to which the second embodiment is actually applied will be described.

Example 3

The roller 4 serving as a stage was provided with a hand-drum-like configuration and a radius of curvature of 20 mm as seen in a sectional front view. The roller 3 was covered with a rubber lining. The abrasive film 2 for primary working consisted of a 150 m long, 25 mm wide and 25 μm thick base, and $Al_2O_3$ abrasive grain with a gain size of 8 μm. The abrasive film 2 for secondary working consisted of a 100 m long, 25 mm wide and 25 μm thick base, and diamond abrasive grain deposited on the base and having a grain size of 1.5 μm. The workpiece 7 was implemented as an optical fiber connector having a glass ferrule having a diameter of 2.5 mm and in which an optical fiber having a diameter of 125 μm was inserted. The ratio of the outside diameter of a gear mounted on the chuck motor 16 to that of a gear mounted on the chuck 17 was selected to be 2:1, so that the workpiece 7 was rotated twice for one rotation of the motor 16.

The constant load mechanism 19 exerted a load of 150 gf on the workpiece 7 in the vertical direction. In this condition, the chuck motor 16 was rotated at a speed of 200 rpm for 3 minutes for primary working. After 500 consecutive workpieces 7 had been consecutively worked, the abrasive film 2 was replaced with a new abrasive film having a smaller grain size. Then, while the constant load mechanism 19 exerted a load of 150 gf on the ground workpiece 7 in the vertical direction, the chuck motor 16 was rotated at a speed of 200 rpm for 2 minutes for secondary working or finishing.

Example 3 was capable of grinding and finishing 500 consecutive workpieces continuously and reduced the frequency of replacement of the abrasive tool to one-tenth of the frequency particular to the conventional method. The working time for a single workpiece was only 7 minutes, including the time for the replacement of the workpiece and abrasive tool or film 2. The convex tip formed on the end of each workpiece had a radius of curvature of 20±1 mm and a surface roughness of less than 0.03 μm Rmax inclusive. The resulting optical fiber connector was found to have a connection loss of smaller than 0.2 dB inclusive and a reflection attenuation of greater than 45 dB inclusive.

Figure 8:
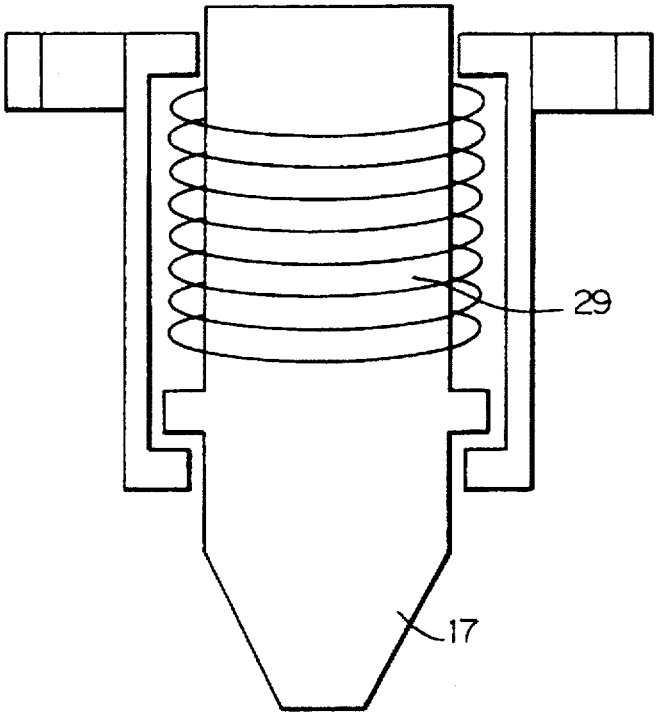
FIG. 8 is a section showing a chuck having a built-in constant load mechanism.

The second embodiment may be so modified as to dispose a constant load mechanism in the chuck 17, as shown in FIG. 8. As shown, a spring 29 is disposed in the chuck 17 and cooperates with the constant load mechanism 19 to urge the workpiece 7 against the abrasive film 2 with a preselected load. With this arrangement, the up-and-down movement of the workpiece 7 is effectively absorbed when the workpiece 7 moves in the lengthwise direction of the roller 4. As a result, the end 8 of the workpiece 7 remains in contact with the film 2 under a predetermined load and can therefore be finished more stably.

Example 4 relating to the above modification is as follows.

Example 4

The chuck 17 with the spring or constant load mechanism built therein, as shown in FIG. 8, was used to work the workpiece 7 under the same conditions as in Example 3. Again, the convex tip formed on the end of the workpiece 7 had a radius of curvature of 20±1 mm and a surface roughness of less than 0.03 μm Rmax inclusive. The resulting optical fiber connector was found to have a connection loss of smaller than 0.2 dB inclusive and a reflection attenuation of greater than 45 dB inclusive.

Figure 9:
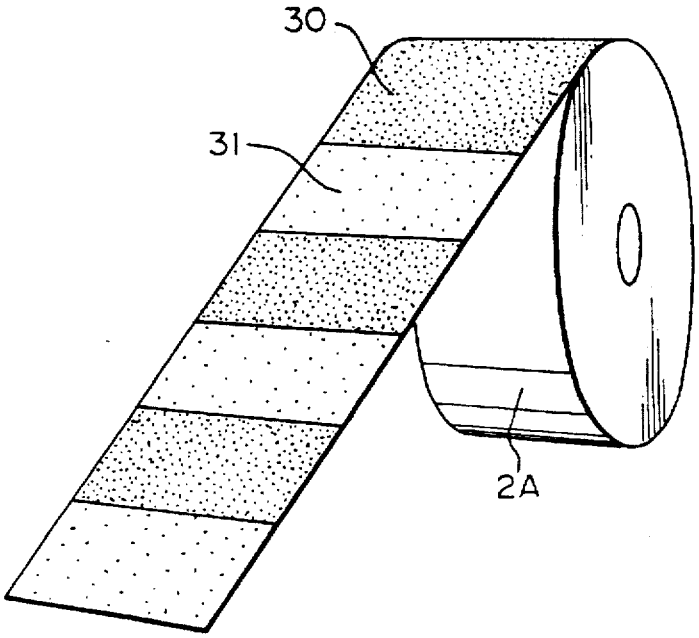
FIG. 9 shows a modified form of a film-like abrasive tool included in the first and second embodiments.

FIG. 9 shows a specific configuration of the abrasive film 2 applicable to the first and second embodiments and their modifications. As shown, an abrasive film 2A has a base on which rough abrasive grain 30 for primary working and fine abrasive grain 31 for secondary working are provided alternately. This kind of abrasive film 2 does not have to be replaced between the primary working and the secondary working, and therefore reduces the working time.

Example 5 using the abrasive film 2A will be described hereinafter.

Example 5

The abrasive film 2A was 150 m long, 25 mm wide and 25 μm thick. The rough abrasive grain 30 and fine abrasive grain 31 were respectively implemented by $Al_2O_3$ having a grain size of 8 μm and diamond having a grain size of 1.5 μm. The two grains 30 and 31 were alternatively deposited on the film 2A over 300 mm and 200 mm, respectively. Basically, the working conditions of Example 5 are identical with those of Example 1 or 3.

Example 5 was capable of grinding and finishing 500 consecutive workpieces continuously with a single 150 m long abrasive film 2A and reduced the frequency of replacement of the abrasive tool to one-sixth of the frequency particular to the conventional method. The working time for a single workpiece was only 6 minutes, including the time for the replacement of the workpiece and abrasive tool or film 2. The convex tip formed on the end of each workpiece had a radius of curvature of 20±1 mm and a surface roughness of less than 0.03 μm Rmax inclusive. The resulting optical fiber connector was found to have a connection loss of smaller than 0.2 dB and a reflection attenuation of greater than 45 dB inclusive.

3rd Embodiment

Figure 10:
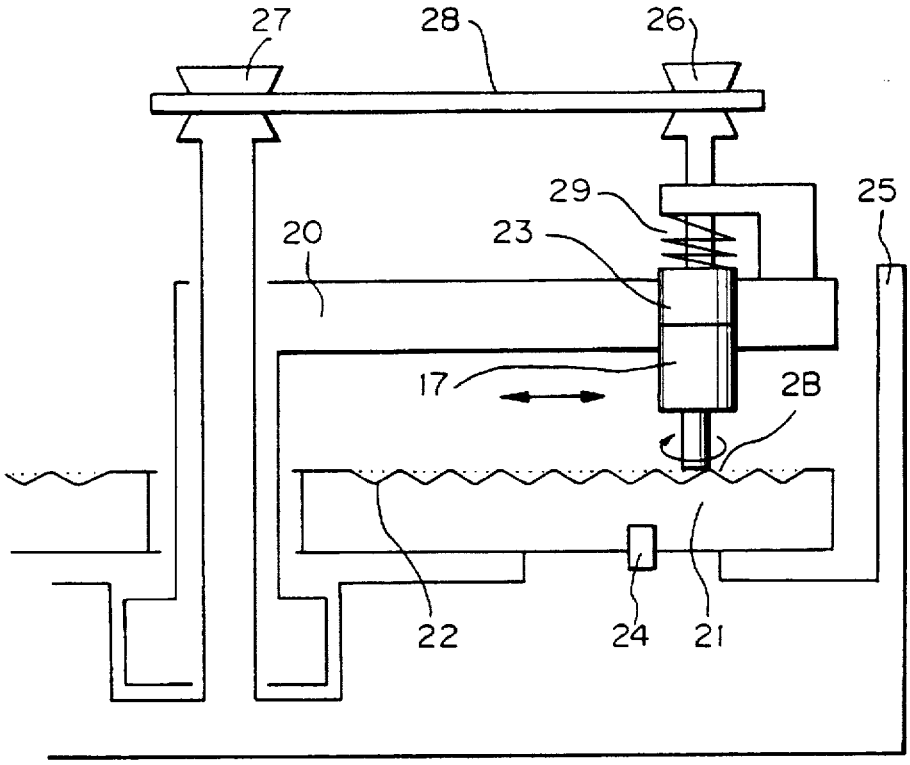
FIG. 10 is a perspective view showing a third embodiment of the present invention.
Figure 11:
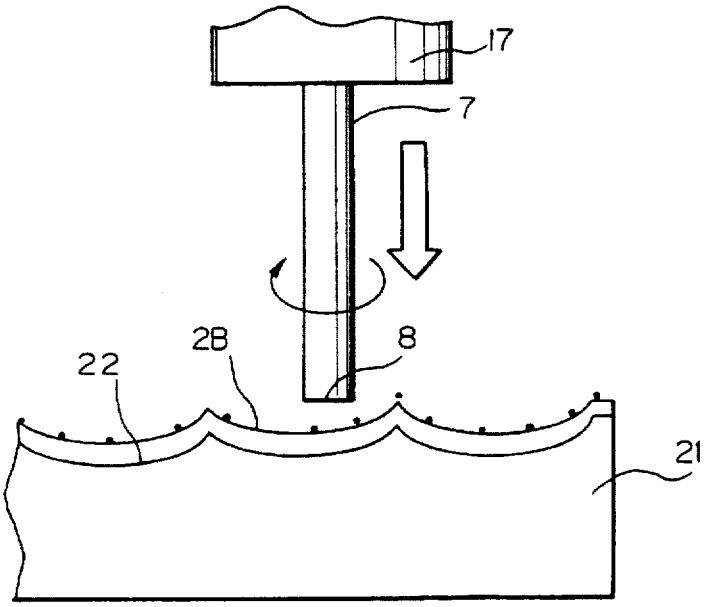
FIG. 11 is a fragmentary enlarged view of the embodiment shown in FIG. 10.

Referring to FIGS. 10 and 11, a third embodiment of the present invention will be described. As shown, the apparatus has a cover 25. A work disk or stage 21 is affixed to the cover 25 by a pin 24 and formed with a plurality of concentric annular grooves 22. An abrasive film 2B is affixed to the top of the work disk 21. The chuck 17 holds the workpiece 7 and is caused to reversibly rotate about its axis by a chuck motor 23. A first pulley 26 is affixed to the output shaft of the chuck motor 23. A second pulley 27 is affixed to the cover 25 at the center of the disk 21. A belt 28 is passed over the pulleys 26 and 26. The chuck 17 is caused to slide along an arm 20 in the radial direction of the work disk 21 by a moving mechanism, not shown. A spring 29 exerts a preselected load on the workpiece 7 in order to hold it in contact with the abrasive film 2B. The abrasive film 2B is adhered to the top of the work disk 21 beforehand. The moving mechanism mentioned above also serves to position the axis of rotation of the workpiece 7 at the center of any one of the concentric grooves 22 formed in the work disk 21.

When the motor 23 is energized, it causes the workpiece 7 to rotate about its axis. At the same time, the rotation of the motor 23 is transmitted to the second pulley 27 via the first pulley 26 and belt 28, causing the workpiece 7 to revolve along any one of the grooves 22 above the work disk 21. While the workpiece 7 urged against the abrasive film 2B by the spring 29 is caused to rotate and revolve, the arc of the groove 22, as seen in a section, underlying it is transferred to the end 8 due to the the abrasive film 2B. As a result, a convex tip is formed at the end 8 of the workpiece 7 is When the working ability of the part of the film 2 existing in the groove 22 in use is lowered, the workpiece 7 is slid in the radial direction of the work disk 21 and again positioned such that it revolves along another groove 22 adjoining the above groove.

Because the concavity of each groove 22 of the work disk 21 is free from deformation ascribable to the working, the end 8 of the workpiece 7 can be stably worked in a convex configuration. The end 8 can be provided with a radius equal to the radius of curvature of the groove 22. Further, because the work disk 21 is formed with a plurality of concentric grooves 22, it is possible to reduce the frequency of replacement of the abrasive film 2B. In addition, when all the grooves 22 of the work disk 21 are used, a new abrasive film 2B should only be adhered to the disk 21 in place of the used abrasive film 2B; that is, the replacement of the tool is simple and easy.

Example 6 relating to the third embodiment will be described hereinafter.

Example 6

The work disk 21 had a diameter of 260 mm and was formed with sixty concentric annular grooves 22 each having a radius of curvature of 20 mm at a pitch of 2 mm. The abrasive film 2B for primary working consisted of a 25 μm thick base having a diameter of 260 mm, and $Al_2O_3$ abrasive grain deposited on the base and having a grain size of 3 μm. The workpiece 7 was implemented as an optical fiber connector having a glass ferrule with a diameter of 2.5 mm and in which an optical fiber having a diameter of 125 mm was inserted. The chuck 17 holding the workpiece 7 was slid until the axis of rotation of the workpiece 7 aligned with the center of the radially outermost groove 22, as seen in a section, of the work disk 21. The ratio of the outside diameter of the first pulley 26 to that of the second pulley 27 was selected to be 1:2, so that the workpiece 7 rotated about its axis twice for a single revolution around the work disk 21.

The spring 29 exerted a load of 150 gf on the workpiece 7 in the vertical direction. In this condition, the motor 23 was rotated at a speed of 100 rpm for 3 minutes for primary working. Then, the workpiece 7 was removed from the chuck 17 and replaced with another workpiece 7. The chuck 17 holding the new workpiece 7 was slid to the center of the groove 22 next to the radially outermost groove 22. The slackening of the belt 28 ascribable to the slide of the chuck 17 was removed by a belt tensioner, not shown. The above procedure was repeated with 60 consecutive workpieces 7. Subsequently the abrasive film 2B was replaced with a new abrasive film 2B for secondary working or finishing. The new film 2B consisted of a 25 μm thick base having a diameter of 260 mm, and diamond abrasive grain deposited on the base and having a grain size of 1.5 μm. The sixty workpieces 7 undergone primary working were each finished for 2 minutes by the new abrasive film 2B.

Example 6 reduced the frequency of replacement of the abrasive tool to one-half of the conventional frequency. The period of time necessary for the replacement of the workpiece 7 and the period of time necessary for the replacement of the abrasive tool were as short as 30 seconds and 1 minute, respectively. The convex tip formed on the end of each workpiece had a radius of curvature of 20±1 mm and a surface roughness of less than 0.03 μm Rmax inclusive. The resulting optical fiber connector was found to have a connection loss of smaller than 0.2 dB inclusive and a reflection attenuation of greater than 45 dB inclusive.

Figure 12:
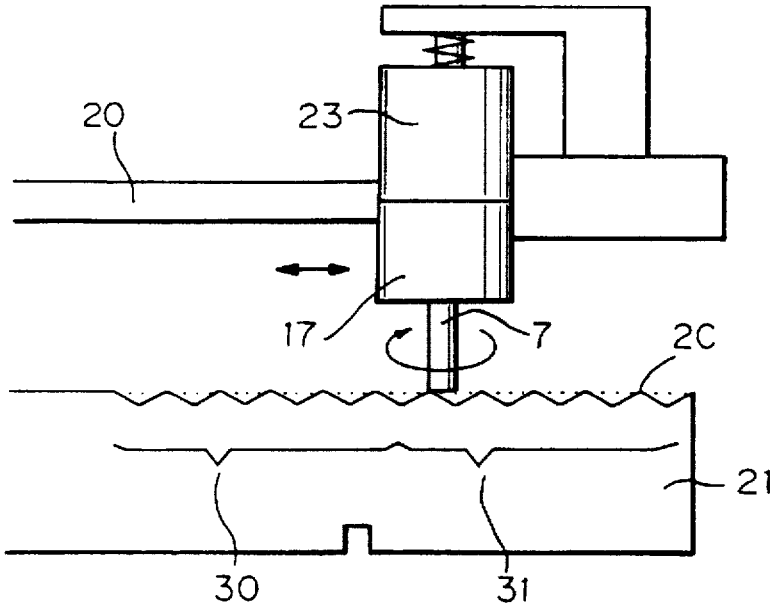
FIG. 12 is a front view showing a first modification of the third embodiment.

A first modification of the third embodiment will be described with reference to. FIG. 12. As shown, the fine abrasive grain 31 for secondary working and the rough abrasive grain 30 for primary working are respectively deposited on the radially outer part and the radially inner part of an abrasive film 2C. The chuck 17 is slid to align the axis of rotation of the workpiece 7 with the center of one of the grooves 22 below the rough abrasive grain 30. After the workpiece 7 has been ground (primary working) due to its rotation and revolution, the chuck 17 is slid radially outward toward another groove lying below the fine abrasive grain 31. Then, the workpiece 7 is finished with its axis of rotation aligning with the center of the above groove 22 (secondary working).

The above modification makes it needless to replace the abrasive film 2C and implements continuous primary working and secondary working. In addition, because the workpiece 7 is finished by the radially outer portion of the film 2C, more fine abrasive grain 31 can act on the end 8 of the workpiece 7 than during grinding.

Example 7 relating to the above first embodiment is as follows.

Example 7

The work disk 21 had a diameter of 260 mm and was formed with sixty concentric grooves 22 each having a radius of curvature of 20 mm at a pitch of 2 mm, as in Example 6. The abrasive film 2C consisted of a 25 μm thick base having a diameter of 260 mm, $Al_2O_3$ abrasive grain 30 having a grain size of 3 μm and deposited on the part of the base capable of covering thirty radially inner grooves 22, and diamond abrasive grain 31 having a grain size of 1.5 μm and deposited on the other part of the base capable of covering thirty radially outer grooves 22.

The chuck 17 holding the workpiece 7 positioned the axis of rotation of the workpiece 7 at the radially innermost groove 22. The workpiece 7 was ground for 3 minutes under a load of 150 gf, then shifted to the first radially outer groove 22, and then finished for 2 minutes. The next workpiece 7 was ground by the groove 22 next to the radially innermost groove 22, and then finished by the groove 22 next to the first radially outer groove 22.

Example 7 was capable of performing grinding and finishing continuously in 5 minutes and 30 seconds without replacing the abrasive film 2C. The convex tip formed on the end of each workpiece had a radius of curvature of 20±1 mm and a surface roughness of less than 0.03 μm Rmax inclusive. The resulting optical fiber connector was found to have a connection loss of smaller than 0.2 dB inclusive and a reflection attenuation of greater than 45 dB inclusive.

A second modification of the third embodiment will be described with reference to FIG. 13. As shown, the fine abrasive grain 31 for secondary working and rough abrasive grain 30 for primary working are alternately arranged on an abrasive film 2D and identical in width and pitch as the concentric grooves 22. First, the workpiece 7 is ground with its axis of rotation aligned with the radially outermost groove 22 below the rough grain 30. Then, the workpiece 7 is shifted radially inward to the groove 22 next to the above groove 22 and underlying the fine grain 31. In this position, the workpiece 7 is finished by the fine grain 31.

The second embodiment is capable of performing primary working and secondary working continuously without replacing the abrasive film 2D. In addition, the embodiment minimizes the displacement of the workpiece 7, i.e., the chuck 17 between primary working and secondary working.

Example 8 relating to the above second modification is as follows.

Example 8

Figure 13:
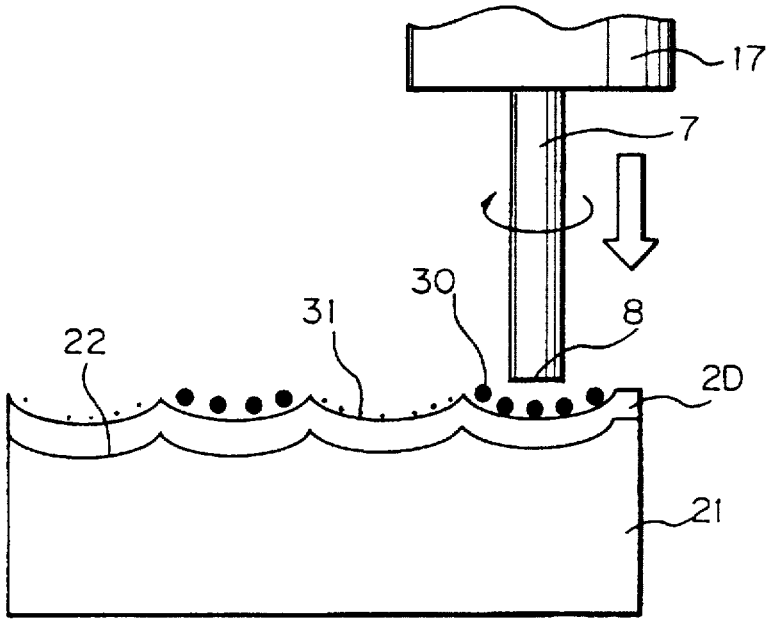
FIG. 13 is a front view showing a second modification of the third embodiment.

As shown in FIG. 13, an $Al_2O_3$ layer (rough abrasive grain 30) having a grain size of 3 μm and a layer of diamond (fine abrasive grain 31) having a grain size of 1.5 μm were alternately formed on the abrasive film 2D and identical in width and pitch with the grooves 22. The abrasive film 2D had a diameter of 260 mm. The end 8 of the workpiece 7 was worked under basically the same conditions as in Example 6. In Example 8, the workpiece 7 was ground for 3 minutes by the radially outermost groove 22 and then finished for 2 minutes by the groove 22 next to the outermost groove 22. The next workpiece 7 was ground by the next radially inner groove 22 and then finished by the groove 22 adjoining the above groove.

Embodiment 8 reduced the displacement of the workpiece 7 between primary working and secondary working. Consequently, the workpiece 7 could be ground and finished continuously in 5 minutes and 15 seconds without the replacement of the abrasive film 2D. The convex tip formed on the end of each workpiece had a radius of curvature of 20±1 mm and a surface roughness of less than 0.03 μm Rmax inclusive. The resulting optical fiber connector was found to have a connection loss of smaller than 0.2 dB inclusive and a reflection attenuation of greater than 45 dB inclusive.

4th Embodiment

Figure 14:
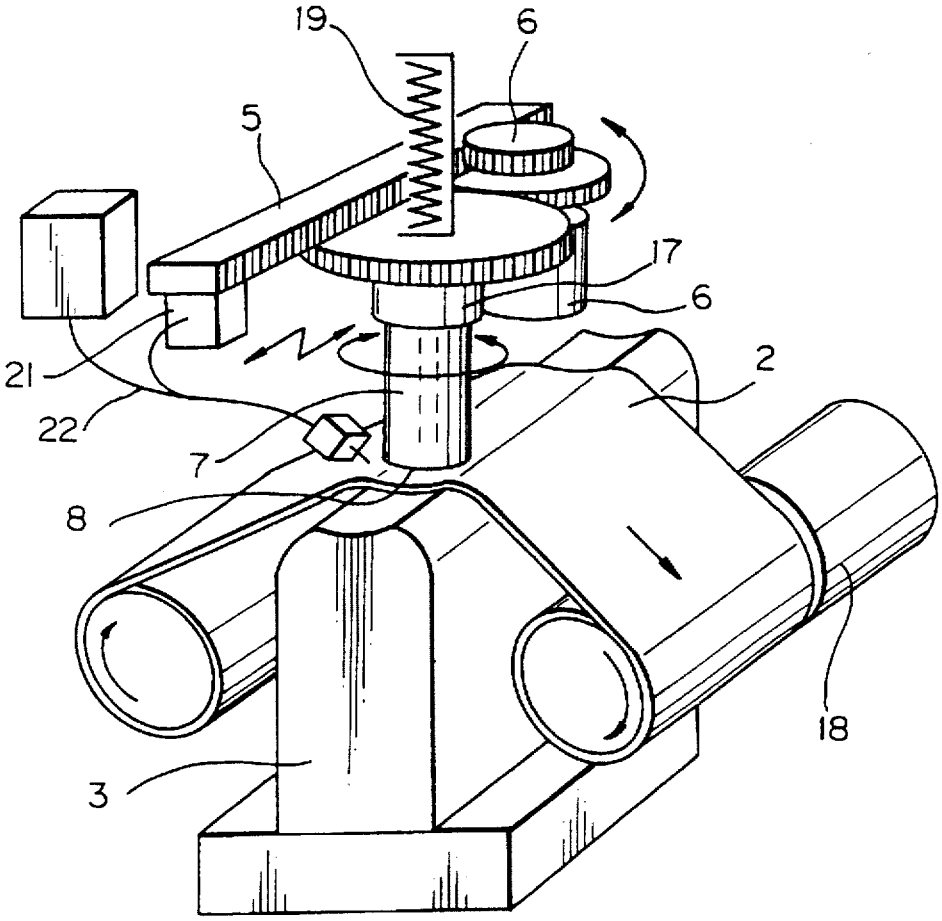
FIG. 14 is a perspective view showing a fourth embodiment of the present invention.
Figure 15:
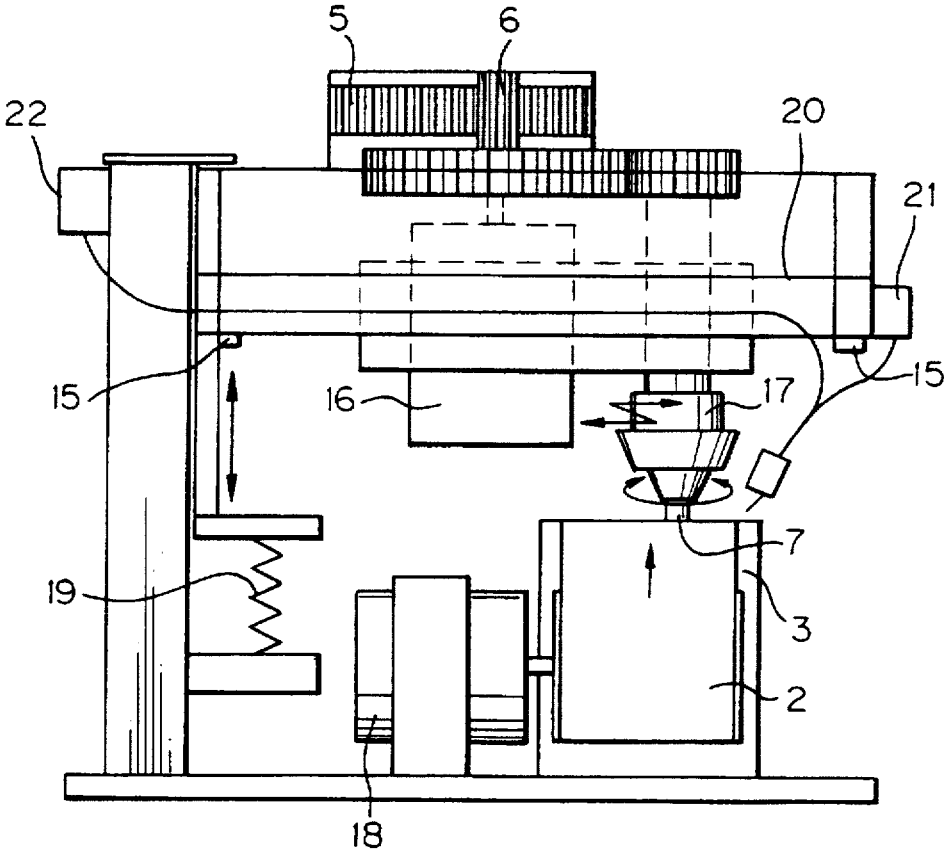
FIG. 15 is a front view showing the fourth embodiment in detail.

A reference will be made to FIGS. 14 and 15 for describing the construction and operation of a fourth embodiment of the present invention. This embodiment is similar to the first embodiment, FIGS. 3 and 4, except for the addition of a piston 21 and a mist supply mechanism 22. Specifically, the rack 5 and pinion 6 move the chuck 17 in the lengthwise direction of the rack 5. When the end 8 of the workpiece 7 arrives at one end of the stage 3, the piston 2 is pressed and causes the mist supply mechanism to spray an alcohol-containing abrasive liquid in the form of a mist onto the working point. At the same time, the switch 15 is operated to reverse the rotation of the chuck motor 16. As a result, the workpiece 7 is moved back and forth while rotating about its axis and ground in a convex configuration thereby. When the abrasive film 2 is fully taken up by the take-up roller (no numeral) due to the working of a plurality of consecutive workpieces 7, it is replaced with a new abrasive film having a smaller grain size. Then, the workpieces 7 are sequentially finished by the new film 2. This sequentially provides the end 8 of each workpiece 7 with a smooth convex configuration.

Example 9 relating to the fourth embodiment is as follows.

Example 9

In Example 9, the workpiece 7 was worked under substantially the same conditions as in Example 1. For the abrasive liquid, use was made of pure water containing 50% of alcohol. Example 1 could grind and finish 500 consecutive workpieces 7 and was free from the drop of the liquid and other troubles even when tilted. The working time for a single workpiece was only 7 minutes, including the time for the replacement of the workpiece and abrasive tool or film 2. The convex tip formed on the end of each workpiece had a radius of curvature of 20±1 mm and a surface roughness of less than 0.01 μm Rmax inclusive. The resulting optical fiber connector was found to have a connection loss of smaller than 0.2 dB inclusive and a reflection attenuation of greater than 47 dB inclusive.

5th Embodiment

Figure 16:
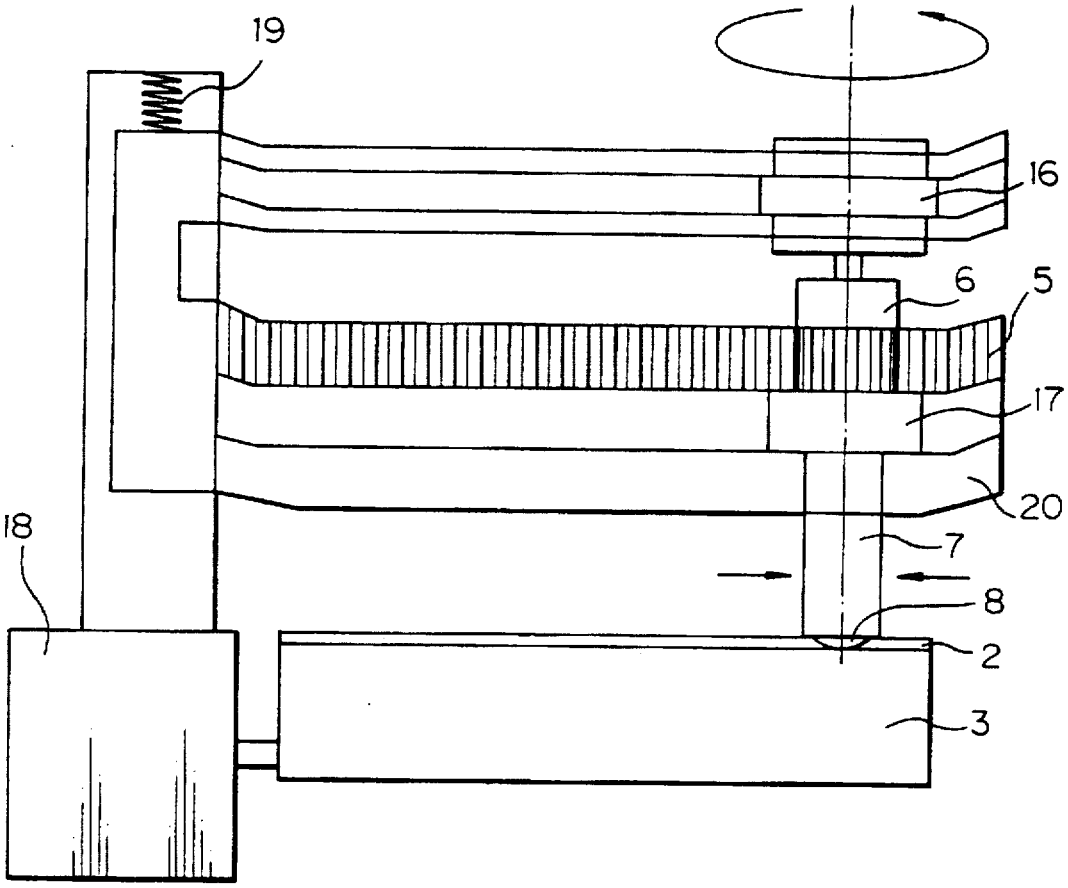
FIG. 16 is a front view showing a fifth embodiment of the present invention.

FIG. 16 shows a fifth embodiment of the present invention. As shown, the rail 20 for guiding and holding the workpiece 7 is bent upward at opposite ends thereof. In this condition, when the chuck 17 is moved in the lengthwise direction of the rack 5 by the rack 5 and pinion 6, the end 8 of the workpiece 8 moves to one end of the stage 3 while rotating about its axis, and then begins to move toward the other end without any load acting thereon. As a result, the end 8 is ground in a convex configuration. When the abrasive film 2 is fully taken up due to the primary working repeated with a plurality of workpieces 7, it is replaced with a new abrasive film having a smaller grain size. Then, the workpieces 7 undergone primary working are finished one by one.

Example 10 relating to the fifth embodiment is as follows.

Example 10

Example 10 also worked the end 8 of the workpiece 7 under substantially the same conditions as in Example 1. The constant load mechanism 19 exerted a constant load of 200 gf (not 150 gf) in the vertical direction. Example 10 could grind and finish 500 consecutive workpieces 7 and was free from unexpected scratches and other troubles. The working time for a single workpiece was only 7 minutes, including the time for the replacement of the workpiece 7 and abrasive tool or film 2. The convex tip formed on the end of each workpiece had a radius of curvature of 20±1 mm and a surface roughness of less than 0.01 μm Rmax inclusive. The resulting optical fiber connector was found to have a connection loss of smaller than 0.2 dB inclusive and a reflection attenuation of greater than 45 dB inclusive.

6th Embodiment

Figure 17A:
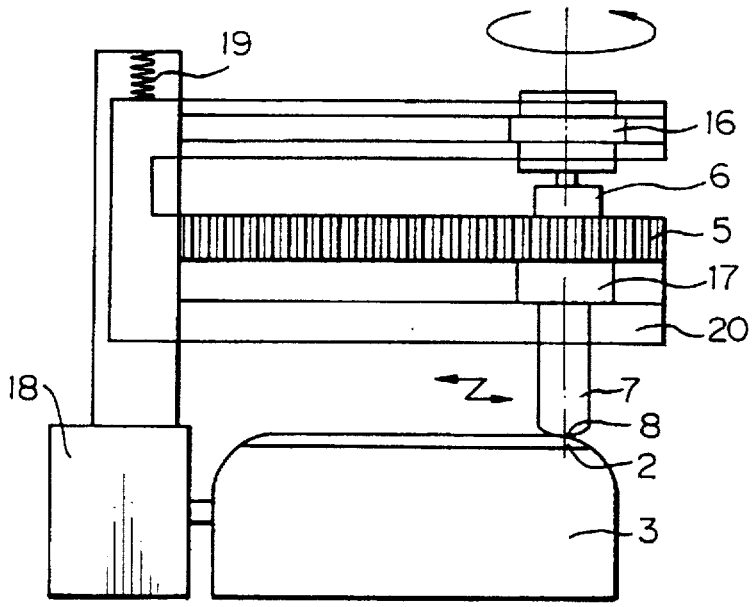
FIGS. 17A and 17B are respectively a front view and a side elevation showing a sixth embodiment of the present invention.
Figure 17B:
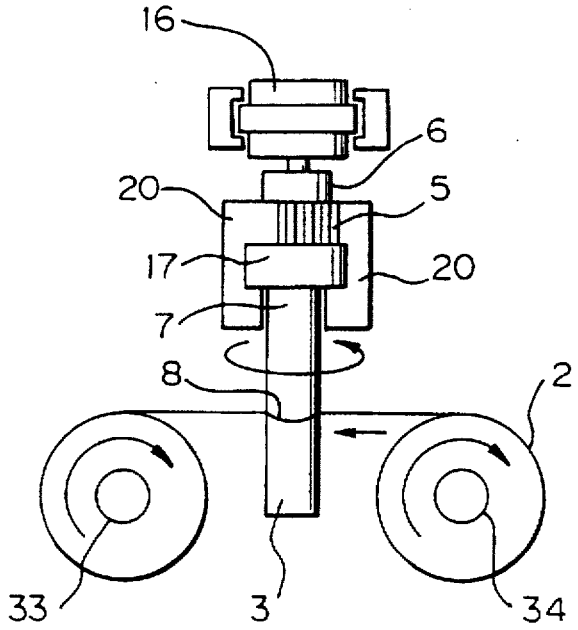

FIGS. 17A and 17B show a sixth embodiment of the present invention. As shown, the stage 3 is smoothly curved at longitudinally opposite ends thereof. In this condition, when the chuck 17 is moved in the lengthwise direction of the rack 5 by the rack 5 and pinion 6, the end 8 of the workpiece 8 moves to one end of the stage 3 while rotating about its axis, and then begins to move toward the other end without any load acting thereon. As a result, the end 8 is ground in a convex configuration. When the abrasive film 2 is fully taken up due to the primary working repeated with a plurality of workpieces 7, it is replaced with a new abrasive film having a smaller grain size. Then, the workpieces 7 undergone the primary working are finished one by one.

Example 11 relating to the sixth embodiment is as follows.

Example 11

Example 11 worked the end 8 of the workpiece 7 under substantially the same conditions as in Example 10 and achieved equivalent results.

In the first to sixth embodiments and Examples 1–11, the workpiece 7 is implemented as an optical fiber connector consisting of a glass ferrule and an optical fiber inserted in the ferrule and formed of quartz. A desirable convex tip is achievable even when the ferrule is formed of zirconia ceramic or plastic or even when it is replaced with a rod or a block. While the rough grain 30 and fine grain 31 are respectively implemented by $A1_2O_3$ and diamond, the former and latter may be respectively implemented by SiC and $CeO_2$.

The first to sixth embodiments shown and described have various advantages as enumerated below.

(1) A ferrule for an optical fiber connector or similar workpiece formed of one or more materials can have its end accurately mirror-finished in a convex configuration.

(2) The frequency of replacement of tools is reduced. This implements far higher productivity than conventional working methods.

(3) Even when the working apparatus is tilted, it is free from troubles including the drop of a liquid and unexpected scratches.

(4) When the workpiece begins to move backward while rotating, no loads act on the workpiece. This protects the end of the workpiece from scratches ascribable to a sharp change in working load.

Figure 18A:
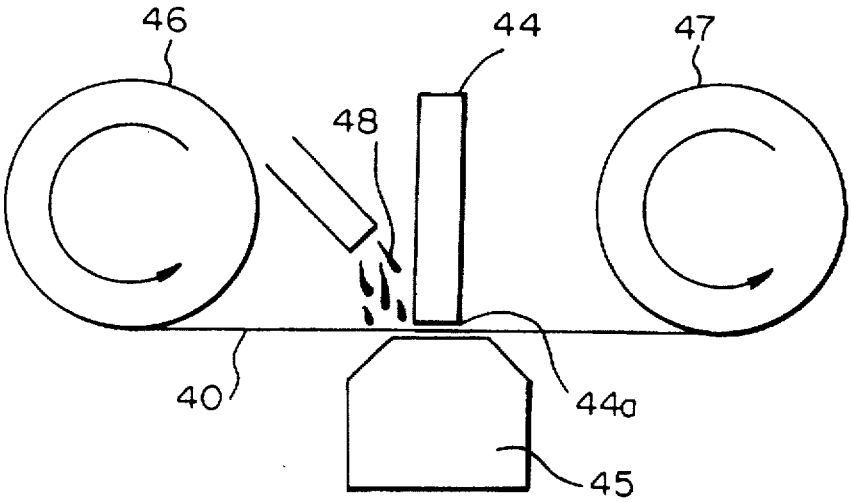
Fig. 18A PRIOR ART
FIG. 18A is a side elevation showing a conventional convex tip forming apparatus.
Figure 18B:
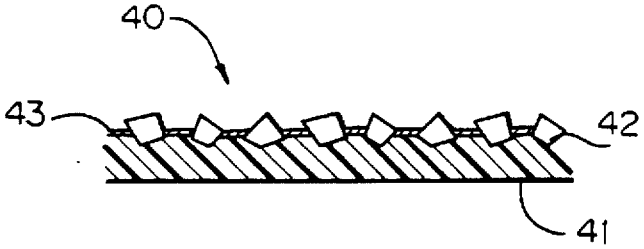
Fig. 18B PRIOR ART
FIG. 18B is a fragmentary enlarged section of a lapping tape used in the conventional apparatus shown in FIG. 18A.

Referring to FIG. 18A, another conventional apparatus is shown which works the end of a rod or that of a block without regard to the material constituting it. FIG. 18B shows an abrasive tool in the form of a tape 40 used in the apparatus of FIG. 18A. As shown in FIG. 18B, the lapping tape 40 consists of a base 41 and abrasive grain 42 affixed to the surface of the tape 40 by a binder 43. As shown in FIG. 18A, a workpiece 44 is urged against a stage 45 via the lapping tape 40 in the vertical direction while rotating about its axis. While the lapping tape 40 is sequentially fed from a feed roller 46 and taken up by a take-up roller 47, an abrasive liquid 48 is fed to the tape 40 in the form of drops at the upstream side of the workpiece 44 with respect to the direction of movement of the tape 40. The liquid 48 promotes the discharge of dust and the cooling of the working point. In this manner, the apparatus sequentially works the workpiece 44 while obviating the stop-up of the tape 40 and heat ascribable to grinding. Usually, the abrasive liquid 48 is implemented by water or similar liquid.

A problem with the above conventional apparatus is that it needs a apparatus for feeding the abrasive liquid 48 and a tank for storing the liquid 48. This prevents the apparatus from being miniaturized. Another problem is that the apparatus cannot be easily transported because the liquid 48 drops if the apparatus is tilted. A further problem is that the apparatus must be held in a horizontal position during the course of work.

Other embodiments of the present invention free from the above problems will be described hereinafter.

7th Embodiment

Figure 19A:
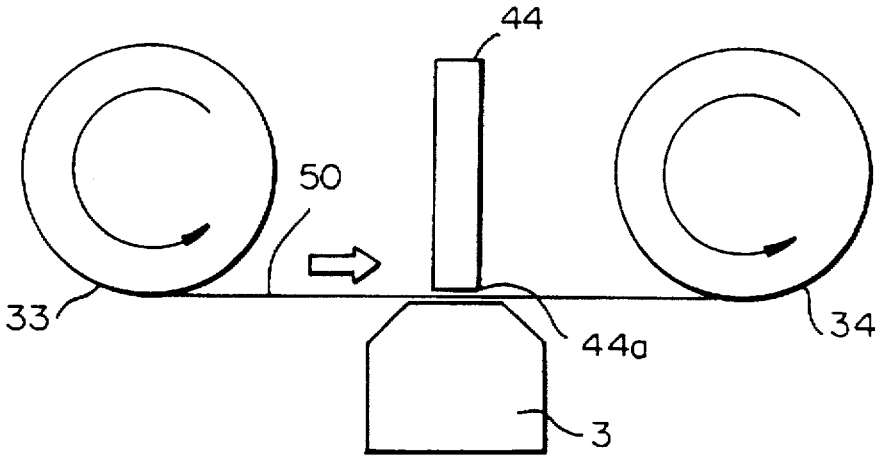
FIG. 19A is a side elevation showing a seventh embodiment of the present invention.
Figure 19B:
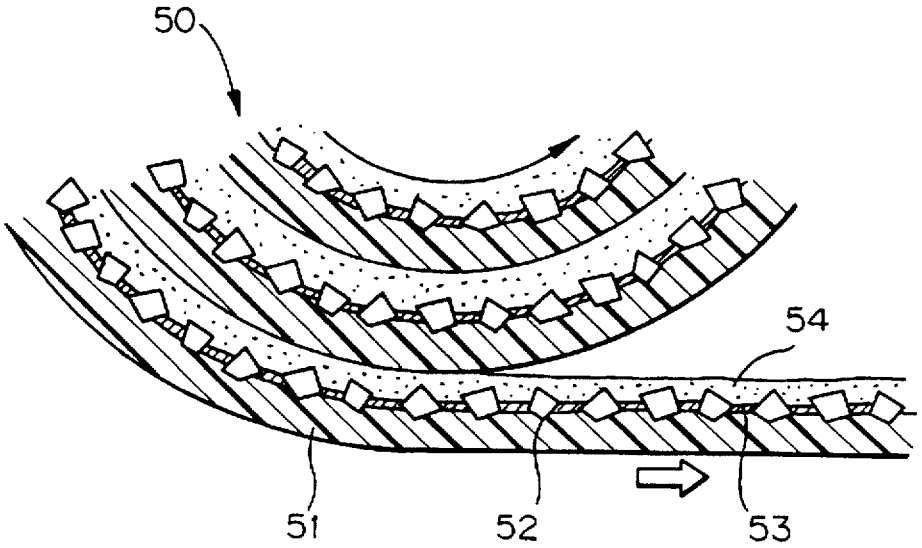
FIG. 19B is a fragmentary enlarged section showing a lapping tape for use in the seventh embodiment and implemented as a roll.

FIG. 19A shows a seventh embodiment of the present invention while FIG. 19B shows a lapping tape 50 applicable thereto. As shown in FIG. 19B, the lapping tape 50 consists of a thin flexible base or webbing little permeable to an abrasive liquid and air, diamond or similar abrasive grain 52 affixed to the base 51 by a binder 53, e.g., resin, and an abrasive liquid 54 covering the abrasive grain 52 in the form of fine drops or a thin layer. Before the abrasive liquid 54 evaporates, the tape 50 is wound round a feed roller 33. Before the tape 50 is paid out from the feed roller 33, the front of the base 51 is held in close contact with the rear of the same. In this condition, the base 51 intercepts the liquid 54 and air and thereby causes the liquid 54 to evaporate little. Because the abrasive 54 is deposited only in an amount sufficing for the work, it does not drop even when the apparatus is tilted.

In operation, when the take-up roller 34 is rotated, the tape 50 is paid out from the feed roller 33 and conveyed via the gap between the stage 3 and the workpiece 44. A preselected load is exerted on the workpiece 44 in the vertical direction while the workpiece 44 is rotated about its axis. As a result, the workpiece 44 has its end **44*a* worked to form a convex tip. The liquid 54 deposited on the tape 50** beforehand implements a minimum necessary amount of abrasive liquid, thereby promoting the discharge of dust and the cooling of heat Example 12 relating to the seventh embodiment is as follows.

Example 12

The stage 3 was formed of Teflon. The lapping tape 50 consisted of a 150 m long, 25 mm wide and 25 μm thick base formed of polyester, and diamond abrasive grain deposited on the base and having a grain size of 1.5 μm. For the abrasive liquid 54, use was made of pure water. The liquid 54 was sprayed onto the tape 50 as a mist to a thickness of about 10 μm. Then, the tape 50 was wound round the feed roll 33. The workpiece 44 was implemented as an optical fiber connector having a glass ferrule with a diameter of 2.5 mm and an optical fiber having a diameter of 125 μm and inserted in the ferrule. The workpiece 44 was rotated at a speed of 200 rpm under a load of 250 gf and worked for 2.5 minutes. The tape 50 was fed at a rate of 100 mm per minute. Every time 500 consecutive workpieces 44 were worked, the tape 50 was replaced with a new tape.

Example 12 was capable of providing the workpiece 44 with a smooth convex tip having a surface roughness of 0.03 μm Rmax or below which is equivalent to the surface roughness available with the conventional implementation.

8th Embodiment

Figure 20A:
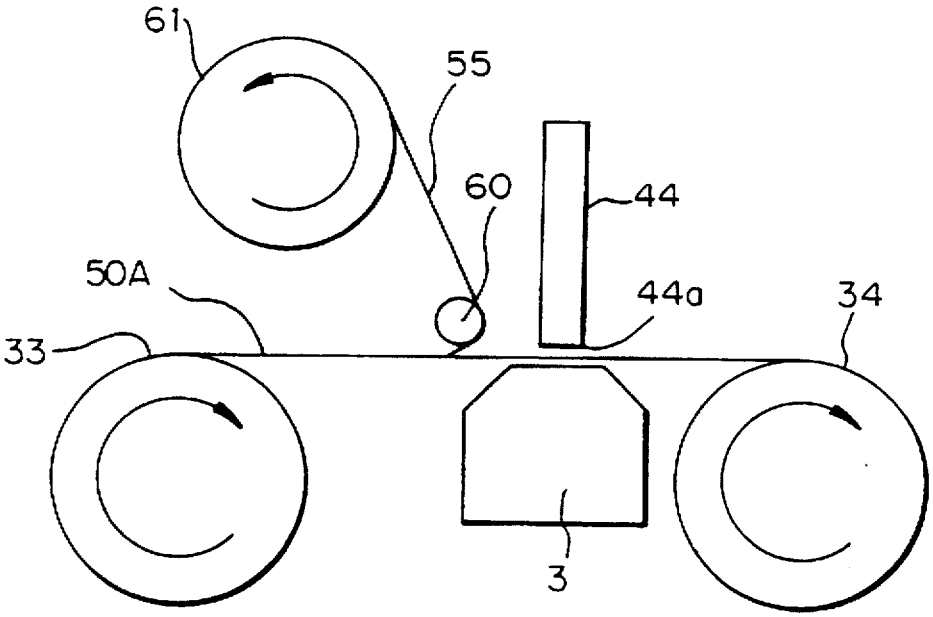
FIG. 20A is a side elevation showing an eighth embodiment of the present invention.
Figure 20B:
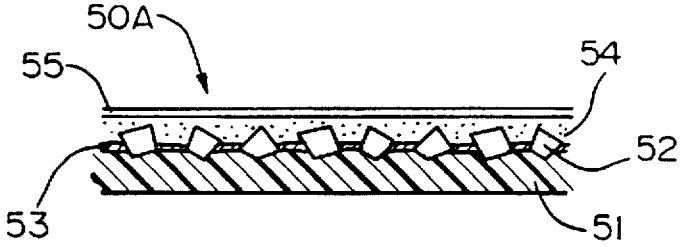
FIG. 20B is a fragmentary enlarged section of a lapping tape for use in the eighth embodiment and also implemented as a roll.

FIG. 20A shows an eighth embodiment of the present invention while FIG. 20B shows a lapping tape 50A applicable thereto. As shown, the lapping tape 50A is different from the lapping tape 50 in that a film 55 is laid on and held in close contact with the surface of the abrasive liquid 54. Before the film 55 is peeled off from the tape 50A and before it is mounted to the feed roller 33, the surface of the base 51 and the film 55 remain in contact with each other. In this condition, the film 55 intercepts the liquid 54 and air and thereby prevents the liquid 54 from evaporating. A guide roller 60 is positioned at the upstream side of the working point in order to peel off the film 55 from the base 51. The tape 50A is sequentially conveyed through the gap between the stage 3 and the workpiece 44 while having the film 55 sequentially peeled off by the guide roller 60. The film 55 is sequentially taken up by a film take-up roller 51.

This embodiment differs from the seventh embodiment in that the film 55 is peeled off from the tape 50A at a position immediately before the workpiece 44, so that the surface of the base 51 is uncovered. Therefore, the distance between the point where the surface of the base 51 is exposed to the atmosphere and the working point is short. Experiments showed that this embodiment minimizes the evaporation of the liquid 54, compared to the seventh embodiment.

Even when the amount of the abrasive liquid 54 was one-half of the amount in the eighth embodiment, the eighth embodiment could obviate the stop-up of the lapping tape 50A and the generation of heat and provide the workpiece with an accurate convex tip. The embodiment made it needless to replenish the abrasive liquid and obviated the drop of the liquid 54.

In the seventh embodiment, when the workpiece 44 is replaced or when the grinding operation is interrupted, the liquid 54 is caused to evaporate over the area of the lapping tape 50 between the feed roll 33 and the working point. By contrast, in the illustrative embodiment, the film 55 caused the liquid 54 to evaporate only over a short range. As to the lapping tape 50, the portion from which the liquid 54 has been evaporated must be fed wastefully.

While the feed roller 33 and take-up roller 34 shown in FIG. 20A are rotated in the direction opposite to the direction shown in FIG. 19A, they may be positioned and rotated in the same manner as shown in FIG. 19A.

Example 13 relating to the eighth embodiment is as follows.

Example 13

The stage 3, the adhesive tape 50A and abrasive grain 52 each had the configuration described in relation to Example 12. The abrasive film 55 was formed of polyester and was 25 μm thick and 25 mm wide. The guide roller 60 had a diameter of 33 mm and peeled off the film 55 from the base 51 at a point 8 mm short of the working point.

Example 13 is capable of reducing the evaporation of the abrasive liquid 54, compared to the seventh embodiment. In light of this, the liquid or pure water 54 was sprayed in the form of a mist to a thickness of about 5 μm. Before the liquid 54 evaporated, it was covered with the film 55. The resulting lapping tape 50A was wound round the feed roller 33. The workpiece 44 was implemented as an optical connector consisting of a glass ferrule having a diameter of 2.5 mm and an optical fiber having a diameter of 125 μm and inserted in the ferrule, as in Example 12. The workpiece 44 was rotated at a speed of 200 rpm under a load of 150 gf while the lapping tape 50A was fed at a rate of 100 mm per minute. In this condition, the workpiece 44 was worked for 2.5 minutes.

Example 13 was also capable of providing the workpiece 44 with a smooth convex tip having a surface roughness of less than 0.03 μm Rmax inclusive which is comparable with the surface roughness available with the conventional implementation. In addition, the film 55 obviated the wasteful feed of the tape 50A ascribable to the evaporation of the liquid 54, as stated previously.

9th Embodiment

Figure 21A:
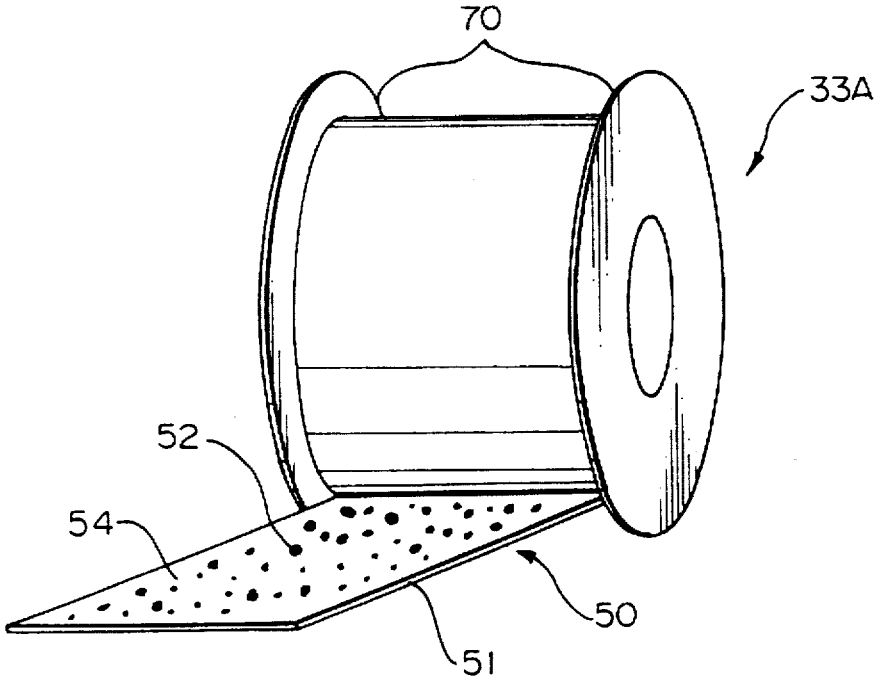
FIG. 21A is a perspective view showing a feed roller round which a lapping tape representative of a ninth embodiment of the present invention is wound.
Figure 21B:
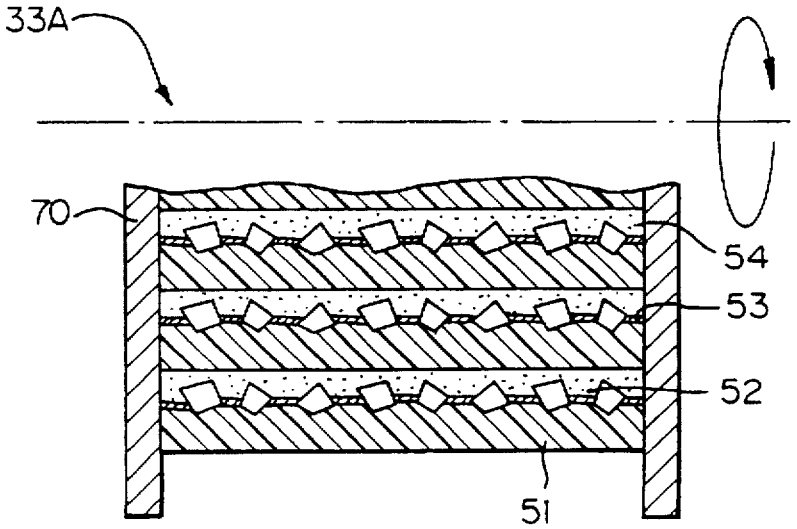
FIG. 21B is a fragmentary enlarged view of the feed roller shown in FIG. 21A.

FIGS. 21A and 21B show a feed roller 33A in accordance with a ninth embodiment of the present invention. As shown, the lapping tape of the eighth embodiment was wound round a feed roller 33A in the form of a roll. The feed roller 33A had disk-like plates 70A at its axially opposite ends. The tape roll was held in close contact with the plates 70 at its opposite ends. The abrasive liquid 54 was deposited on the surface of the base 51 in the form of a layer. The base 51 was wound round the feed roller 33A before the evaporation of the liquid 54. Subsequently, the plates 70 were affixed to the feed roller 33A in close contact with the opposite ends of the tape roll.

The lapping tape 50 was paid out from the feed roller 33A and fed via the gap between the stage 3 and the workpiece 44 in order to work the workpiece 44, as in the seventh and eighth embodiments. The illustrative embodiment also provided with the workpiece 44 with a accurate convex tip while obviating the stop-up of the tape abrasive 50 and the generation of heat. In addition, the embodiment did not need the replenishment of the liquid 54 and did not cause the liquid 54 to drop.

If desired, the lapping tape 50 shown in FIGS. 21A and 21B may be replaced with the lapping tape 50A of the eighth embodiment.

In the seventh or eighth embodiment, the tape roll 50 or 50A in a fresh state has the front and rear of the base 51 held in close contact, but it is not sealed at its axially opposite ends. When such a tape 50 or 50A was simply stored over six months or more, the liquid 54 evaporated from the opposite ends of the tape roll little by little and lowered the grinding ability of the tape. By contrast, the plates 70 contacting the opposite ends of the tape roll 33A successfully sealed them and preserved the expected grinding ability even when the roll 33A was stored for six months or more.

Example 14 relating to the ninth embodiment is as follows.

Example 14

The stage 3, lapping tape 50 or 50A and abrasive grain 52 each had the configuration identical with the configuration described in relation to the eighth embodiment. The abrasive liquid or pure water 54 was sprayed in the form of a mist to a thickness of about 10 μm in order to fabricate the lapping tape 50 or 50A. The lapping tape 50 or 50A was wound round the feed roller 33A before the liquid 54 dried. The plates 70 0.2 mm thick each were affixed to the opposite ends of the feed roller 33A in contact with the corresponding ends of the tape roll. The plates 70 prevented the liquid 54 from drying even when the feed roller 33A with the lapping tape 50 or 50A was stored over six months or more. Example 14 provided the workpiece with a smooth convex tip having a surface roughness of smaller than 0.03 μm inclusive which is comparable with the surface roughness available with the conventional implementation.

10th Embodiment

Figure 22A:
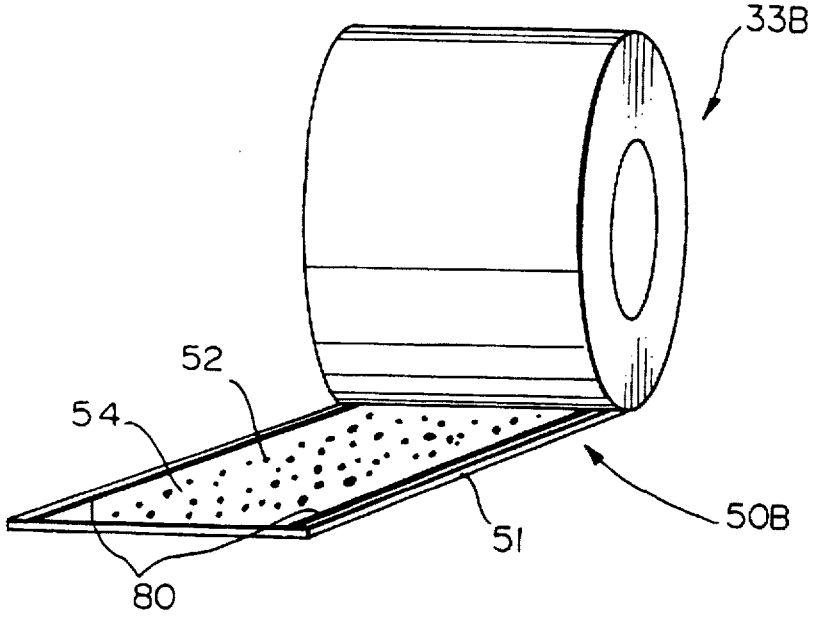
FIG. 22A is a perspective view showing a feed roller round which a lapping tape representative of a tenth embodiment of the present invention is wound.
Figure 22B:
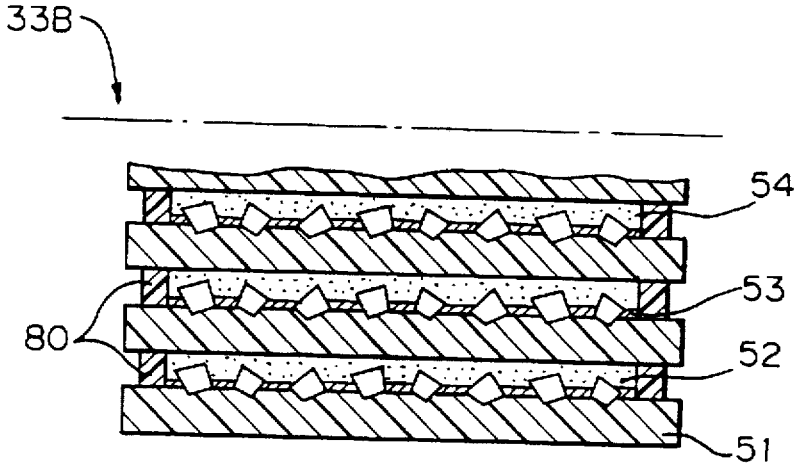
FIG. 22B is a fragmentary enlarged view of the feed roller shown in FIG. 22A.

FIGS. 22A and 22B show a feed roller 33B in accordance with a tenth embodiment of the present invention. As shown, a lapping tape 50B consists of the base 51, the abrasive grain 52 affixed to the base 51, and adhesive 80 applied to the opposite edge portions of the surface of the base 51. Before the adhesive 80 and abrasive 54 dry or evaporate, the lapping tape 50B is wound round the feed roller 33B in the form of a roll.

The tape 50B was paid out from the feed roller 33B and conveyed via the gap between the stage 3 and the workpiece 44 in order to work the workpiece 44, as in the seventh and eighth embodiments. This embodiment also provided the workpiece 44 with an accurate convex tip while obviating the stop-up of the tape 50B and the generation of heat. In addition, the embodiment eliminated the need for the replenishment of the liquid 54 and prevented the liquid 54 from dropping.

When the lapping tape 50B is paid out from the feed roller 33B, the adhesive of the base 51 is separated from the tape roll and allows the surface of the base 51 to be exposed. Before the tape 50B is used, the adhesive 54 continuously seals the opposite edge portions of the tape 50B. This embodiment also preserved the expected grinding ability even when the feed roller 33B with the tape 50B was stored over 6 months or more.

Example 15 relating to the tenth embodiment is as follows.

Example 15

The stage 3, lapping tape 50B and grain 52 each had the configuration stated in relation to Example 12 of the seventh embodiment. First, the adhesive 80 was applied to each edge portion of the surface of the base 51 over a width of 15 μm to a thickness of 20 μm. Then, the abrasive liquid or pure water 54 was sprayed in the form of a mist to a thickness of about 10 μm. The base 51 was wound round the feed roller 33B in the form of a roll before the liquid 54 and adhesive 80 evaporated or dried.

Example 15 also provided, without the replenishment of the liquid 54, the workpiece 44 with a smooth convex tip having a surface roughness of less than 0.03 μm Rmax inclusive which is comparable with the surface roughness available with the conventional implementation. The adhesive 80 sealing the opposite end portions of the base 51 prevented the liquid 54 from drying even when the tape 51 was stored over six months or more.

In the seventh to tenth embodiments and Examples 12–15, the abrasive grain 52 may alternatively be implemented by $Al_2O_3$ or SiC and may be provided with any other suitable grain size. The base 51 may be implemented as a circular or rectangular sheet so long as the abrasive 54 is applied to its surface beforehand. Even city water or a solvent may be used as the abrasive liquid in place of pure water.

Advantages achievable with the seventh to tenth embodiments are as follows.

(1) The lapping tape consists of a base carrying abrasive grain on its surface, and an abrasive liquid in the form of fine drops or a thin layer. The tape therefore makes it needless to feed another abrasive liquid during the course of grinding. In addition, because the liquid promotes the discharge of dust and the cooling of a grinding point, the resulting convex tip is free from scratches and other defects. The apparatus with such a lapping tape is easy to miniaturize and transport and does not cause the liquid to drop even when tilted.

(2) Because the tape is implemented as a roll, the upper and lower surfaces of the liquid closely contact the base and is therefore prevented from evaporating. The evaporation of the liquid will be further obstructed if the tape has its liquid covered with a film, rolled up, and then has the film removed at a point just short of a grinding point.

(3) Disk-like plates may be held in close contact with opposite side edges of the tape roll, or adhesive may be applied to the opposite edge portions of the surface of the base. Then, the plates or the adhesive will seal the opposite edges of the tape after the tape has been rolled up. This successfully prevents the liquid from evaporating and thereby preserves the expected grinding ability even when the tape roll is stored for a long period of time.

Various modifications will become possible for those skilled in the art after receiving the teachings of the present disclosure without departing from the scope thereof.

What is claimed is:

1. A wound lapping tape for forming a convex tip on an end of a workpiece, comprising:

a thin base in a form of a webbing;

abrasive grain affixed to a front of said base by a binder; and an abrasive liquid deposited in a layer on the front of said base to which said abrasive grain is affixed, wherein the lapping tape has said abrasive liquid deposited thereon before the lapping tape is wound.

2. A lapping tape as claimed in claim 1, wherein said lapping tape is wound in a form of a roll such that the front of said base closely contacts a rear of said base.

3. A lapping tape as claimed in claim 2, further comprising a pair of disk-like plates respectively closely contacting axially opposite ends of said roll.

4. A lapping tape as claimed in claim 2, further comprising adhesive applied to opposite edge portions of the front of said base with respective to a widthwise direction of said base over said abrasive liquid.

5. A lapping tape as claimed in claim 2, further comprising a film covering said abrasive liquid.

* * * * *

UNITED STATES PATENT AND TRADEMARK OFFICE

CERTIFICATE OF CORRECTION

PATENT NO. : 5,738,576

DATED : April 14, 1998

INVENTOR(S) : Kenichi OHNO, Torahiko KANDA and Masashige MITSUHASHI

It is certified that error appears in the above-identified patent and that said Letters Patent is hereby corrected as shown below:

Column 9, line 40, delete "is" and insert --.--.

Signed and Sealed this

Twenty-fourth Day of November,1998

*Attest:*

Bruce Lehman

BRUCE LEHMAN

*Attesting Officer*

*Commissioner of Patents and Trademarks*